US010962325B2

(12) United States Patent
Gregory et al.

(10) Patent No.: US 10,962,325 B2
(45) Date of Patent: Mar. 30, 2021

(54) HOLSTER HAVING A REMOVABLE LOCKOUT ELEMENT

(71) Applicant: Vista Outdoor Operations LLC, Farmington, UT (US)

(72) Inventors: Thomas M. Gregory, Belgrade, MT (US); Robert A. Kincaid, Manhattan, MT (US); Clifton L. Cook, Sheridan, WY (US); Eric M. Yeates, Virginia Beach, VA (US); Thomas A. Marx, Virginia Beach, VA (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/154,974

(22) Filed: Oct. 9, 2018

(65) Prior Publication Data

US 2019/0041161 A1 Feb. 7, 2019

Related U.S. Application Data

(63) Continuation of application No. 15/212,226, filed on Jul. 16, 2016, now Pat. No. 10,094,637, which is a (Continued)

(51) Int. Cl.
*F41C 33/02* (2006.01)

(52) U.S. Cl.
CPC ..... *F41C 33/0263* (2013.01); *F41C 33/0209* (2013.01)

(58) Field of Classification Search
CPC .. F41C 33/02; F41C 33/0218; F41C 33/0227; F41C 33/0263; F41C 33/0209; A45F 2200/0591

(Continued)

(56) References Cited

U.S. PATENT DOCUMENTS 1,046,912 A 12/1912 Wanee
1,113,530 A 10/1914 Audley (Continued)

FOREIGN PATENT DOCUMENTS

EP 1975542 10/2008
EP 2757271 7/2014

(Continued)

OTHER PUBLICATIONS

European Patent Office, International Search Report of Application No. 10828676.6, dated Jun. 14, 2016, 3 pages.

(Continued)

*Primary Examiner* — Adam J Waggenspack

(74) *Attorney, Agent, or Firm* — Reed Smith LLP; Matthew P. Frederick; Cheryl L. Gastineau

(57) ABSTRACT

A holster for a handgun, having at least some of an at least partial cavity; a lever having a thumb button portion and an engagement portion, wherein the lever includes a locking projection extending from at least a portion of the engagement portion, wherein the lever is pivotally attached or coupled to at least a portion of the holster, approximately between the thumb button portion and the engagement portion; and a lockout element, wherein at least a portion of the lockout element is positionable to block movement of the lever to keep the lever from being pivoted to a disengaged position.

20 Claims, 27 Drawing Sheets

Related U.S. Application Data continuation of application No. 15/201,552, filed on Jul. 4, 2016, now Pat. No. 10,088,273, which is a continuation of application No. 14/229,944, filed on Mar. 30, 2014, now Pat. No. 9,383,165, which is a continuation of application No. 13/508,759, filed as application No. PCT/US2010/002935 on Nov. 9, 2010, now Pat. No. 8,720,755.

(60) Provisional application No. 61/335,856, filed on Jan. 13, 2010, provisional application No. 61/280,829, filed on Nov. 9, 2009.

(58) Field of Classification Search
USPC ..... 224/193, 242–244, 911, 912
See application file for complete search history.

(56) References Cited

U.S. PATENT DOCUMENTS 1,148,935 A 2/1915 Snavely
1,421,578 A 7/1922 Schussler
1,641,439 A 8/1925 Jovino
1,635,984 A 7/1927 Corriston
1,750,139 A 2/1928 Swift
1,851,352 A 3/1932 Denkert
1,951,865 A 3/1934 Franz
2,051,844 A 8/1936 Green
2,088,811 A 8/1937 Ray
2,109,734 A 3/1938 Preneta
2,349,376 A 5/1944 Ray
2,443,397 A 6/1948 Meyres
2,551,913 A 5/1951 Toby
2,577,869 A 12/1951 Adams
2,893,615 A 7/1959 Couper
3,289,903 A 12/1966 Taormina
3,419,728 A 12/1968 Wilson
3,420,420 A 1/1969 Clark
3,550,821 A 12/1970 Daigle
3,550,822 A 12/1970 Lloyd
3,669,325 A 6/1972 Furman
3,718,240 A 2/1973 Rose
3,777,952 A 12/1973 Theodore
3,804,306 A 4/1974 Azurin
3,828,990 A 8/1974 Baldocchi
3,866,811 A 2/1975 Hamby
3,904,091 A 9/1975 Jones
3,910,469 A * 10/1975 Baldocchi ..... F41C 33/0245 224/198
RE30,139 E 11/1979 Jones
4,277,007 A 7/1981 Bianchi et al.
4,846,384 A 7/1989 Perry
5,018,654 A 5/1991 Rogers et al.
5,048,735 A 9/1991 McCormick
5,082,318 A 1/1992 Held et al.
5,094,376 A 3/1992 Baruch
5,100,036 A 3/1992 Rogers et al.
5,127,566 A 7/1992 Beletsky
5,129,562 A 7/1992 Bianchi
5,199,620 A 4/1993 Beletsky
5,215,238 A 6/1993 Baruch
5,275,317 A 1/1994 Rogers et al.
5,282,559 A 2/1994 Wisser et al.
5,284,281 A 2/1994 Nichols
5,322,200 A 6/1994 Blanchard
5,358,160 A 10/1994 Bianchi
5,372,288 A 12/1994 Rogers et al.
5,395,021 A 3/1995 Brown
5,419,474 A 5/1995 Marx et al.
5,421,497 A 6/1995 Gilmore
5,449,103 A 9/1995 Tilley
5,458,266 A 10/1995 Pichot
5,467,909 A 11/1995 Resca et al.
5,570,830 A 1/1996 Nichols
5,501,380 A 3/1996 Wu
5,501,381 A 3/1996 Rogers et al.
5,509,591 A 4/1996 Carver
5,513,785 A 5/1996 Campagna, Jr.
5,518,155 A 5/1996 Gallagher
5,551,611 A 9/1996 Gilmore
5,573,157 A 11/1996 Mauriello et al.
5,598,958 A 2/1997 Ryan, III et al.
5,611,164 A 3/1997 Rassias
5,622,295 A 4/1997 Hellweg et al.
5,749,507 A 5/1998 Wood
5,758,448 A 6/1998 Thummel
5,768,816 A 6/1998 Rassias
5,779,114 A 7/1998 Owens
5,806,739 A 9/1998 Wood
5,810,221 A 9/1998 Beletsky et al.
5,810,222 A 9/1998 Shoemaker
5,855,305 A 1/1999 Nichols
5,916,087 A 6/1999 Owens
5,918,784 A * 7/1999 Serpa ..... F41C 33/0209 224/244
5,927,578 A 7/1999 Kay
5,931,358 A 8/1999 Rogers
5,944,239 A 8/1999 Rogers et al.
5,961,013 A 10/1999 Collins
6,085,951 A 7/2000 Beletsky et al.
6,112,962 A 9/2000 Matthews
6,149,042 A 11/2000 Rassias
6,189,751 B1 2/2001 Tserng
6,209,575 B1 4/2001 Graziano et al.
6,230,946 B1 5/2001 Vor Keller et al.
6,267,279 B1 7/2001 Matthews
6,276,581 B1 8/2001 Glock
6,320,975 B1 11/2001 Vieweg
6,349,496 B1 2/2002 Neely
6,389,726 B1 5/2002 Bentley
6,397,648 B1 6/2002 Morris et al.
6,398,089 B1 6/2002 Har-Shen
6,415,541 B1 7/2002 Rassias
6,467,660 B1 10/2002 Rogers et al.
6,523,374 B1 2/2003 Owens
6,533,149 B2 3/2003 Vor Keller et al.
6,547,111 B2 4/2003 French
6,585,209 B1 7/2003 Mattingly
6,588,635 B2 7/2003 Vor Keller et al.
6,604,657 B2 8/2003 Yirmiyahu et al.
6,616,020 B1 9/2003 Spielberger
6,634,527 B2 10/2003 Lui
6,641,009 B2 11/2003 French et al.
6,732,891 B2 5/2004 Locklear, III
6,752,300 B2 6/2004 Har-Shen
6,755,331 B2 6/2004 Rassias
6,769,581 B2 8/2004 Rogers et al.
6,769,582 B1 8/2004 Beletsky et al.
6,799,392 B2 10/2004 Milec et al.
D501,991 S 2/2005 Cook et al.
6,854,626 B2 2/2005 Liao
6,886,725 B2 5/2005 Lowe et al.
6,918,519 B2 7/2005 Vor Keller et al.
6,948,644 B1 9/2005 Beletsky
D512,561 S 12/2005 Cook et al.
7,117,625 B2 10/2006 Pikielny
7,140,523 B2 11/2006 Lowe et al.
7,200,965 B2 4/2007 Vor Keller et al.
7,258,259 B1 8/2007 Owens
7,434,712 B2 10/2008 Cook et al.
7,461,765 B2 12/2008 French et al.
7,530,456 B1 5/2009 Tsai
7,543,404 B2 6/2009 Kovalchuk et al.
7,556,181 B2 7/2009 Spielberger
7,562,797 B2 7/2009 Senn et al.
7,584,875 B2 * 9/2009 Lowe ..... F41C 33/0209 224/243
7,591,402 B2 9/2009 Rassias
7,644,845 B2 1/2010 Lowe
7,694,860 B2 4/2010 Clifton, Jr.
7,735,255 B1 6/2010 Kincaid et al.
7,762,018 B1 7/2010 Fitzpatrick et al.
7,819,294 B2 10/2010 Lowe et al.
7,841,497 B1 11/2010 Gregory et al.

(56) References Cited

U.S. PATENT DOCUMENTS

| | | | | |
|---|---|---|---|---|
| 7,850,053 | B2 | 12/2010 | Rassias | |
| 7,922,050 | B2 | 4/2011 | Benes | |
| 7,934,333 | B1 | 5/2011 | Tuz | |
| 7,937,880 | B1 | 5/2011 | Fidlow | |
| 7,950,553 | B2 | 5/2011 | Rassias | |
| 7,954,971 | B1 | 6/2011 | Kincaid et al. | |
| 8,052,018 | B2 | 11/2011 | Gallagher | |
| 8,096,453 | B2 | 1/2012 | Lowe et al. | |
| 8,132,355 | B1 | 3/2012 | Kincaid et al. | |
| 8,141,758 | B2 | 3/2012 | Spielberger | |
| 8,177,108 | B1 | 5/2012 | Kincaid et al. | |
| 8,215,525 | B2 | 7/2012 | Rassias | |
| 8,235,263 | B1 | 8/2012 | Yeates et al. | |
| 8,251,266 | B2 | 8/2012 | Gregory et al. | |
| 8,281,512 | B2 | 10/2012 | Lara | |
| 8,302,827 | B1 | 11/2012 | Cole | |
| 8,371,487 | B1 | 2/2013 | Plappert | |
| 8,474,670 | B1 | 7/2013 | Gregory et al. | |
| RE44,428 | E | 8/2013 | Spielberger | |
| 8,517,235 | B1 | 8/2013 | Kincaid et al. | |
| 8,544,706 | B2 | 10/2013 | Crye | |
| 8,602,275 | B1 | 12/2013 | Kiger et al. | |
| 8,602,276 | B2 | 12/2013 | Tyybakinoja | |
| 8,631,981 | B2 | 1/2014 | Zusman | |
| 8,646,665 | B2 | 2/2014 | Abushaev | |
| 8,690,032 | B2 | 4/2014 | Baumann et al. | |
| 8,714,423 | B1 | 5/2014 | Kincaid et al. | |
| 8,720,753 | B2 | 5/2014 | Benes | |
| 8,720,754 | B2 | 5/2014 | Kirsch | |
| 8,720,755 | B2 * | 5/2014 | Gregory | F41C 33/0263 224/244 |
| 8,783,532 | B2 | 7/2014 | Gregory et al. | |
| 8,807,404 | B1 | 8/2014 | Howell et al. | |
| 8,851,344 | B2 | 10/2014 | Baumann et al. | |
| 8,870,042 | B2 | 10/2014 | Clifton | |
| 8,910,839 | B2 | 12/2014 | Clifton | |
| 8,925,773 | B2 | 1/2015 | Clifton | |
| D723,796 | S | 3/2015 | Resca | |
| 8,985,412 | B2 | 3/2015 | Rorick et al. | |
| 9,016,533 | B2 | 4/2015 | Visalli et al. | |
| 9,022,262 | B2 | 5/2015 | Pellegrini | |
| 9,057,579 | B2 | 6/2015 | Rorick et al. | |
| 9,057,580 | B2 | 6/2015 | Rorick et al. | |
| 9,086,254 | B1 | 7/2015 | Plappert | |
| 9,109,855 | B1 | 8/2015 | Kincel | |
| 9,134,093 | B2 | 9/2015 | Yeates | |
| 9,175,925 | B2 | 11/2015 | Pellegrini | |
| 9,228,802 | B2 | 1/2016 | Ribas | |
| 9,383,165 | B2 * | 7/2016 | Gregory | F41C 33/0263 |
| 2004/0050887 | A1 | 3/2004 | Spielberger | |
| 2004/0195282 | A1 | 10/2004 | Beletsky et al. | |
| 2005/0205621 | A1 | 9/2005 | Shults | |
| 2005/0205624 | A1 | 9/2005 | French et al. | |
| 2005/0279789 | A1 | 12/2005 | Lowe | |
| 2006/0011680 | A1 * | 1/2006 | Cook | F41C 33/0227 224/243 |
| 2006/0156525 | A1 | 7/2006 | Jenkins et al. | |
| 2006/0157520 | A1 | 7/2006 | Clifton, Jr. | |
| 2006/0175366 | A1 | 8/2006 | Dekaise | |
| 2006/0226185 | A1 | 10/2006 | Har-Shen | |
| 2007/0181619 | A1 | 8/2007 | Seyfert et al. | |
| 2008/0110947 | A1 | 5/2008 | Pikielny | |
| 2008/0121670 | A1 | 5/2008 | Buress | |
| 2008/0179359 | A1 | 7/2008 | Aberle et al. | |
| 2008/0179360 | A1 | 7/2008 | Lowe et al. | |
| 2009/0321480 | A1 | 12/2009 | Kincaid et al. | |
| 2010/0276464 | A1 | 11/2010 | Hirt et al. | |
| 2011/0011904 | A1 | 1/2011 | Schultz et al. | |
| 2011/0101063 | A1 | 5/2011 | Zusman | |
| 2011/0163138 | A1 | 7/2011 | Tybakinoja | |
| 2011/0174849 | A1 | 7/2011 | Clifton, Jr. | |
| 2011/0174850 | A1 | 7/2011 | Clifton, Jr. | |
| 2013/0240582 | A1 | 9/2013 | Tyybakinoja et al. | |
| 2014/0048572 | A1 | 2/2014 | Yeates | |
| 2014/0109345 | A1 | 4/2014 | Melville | |
| 2015/0285587 | A1 | 10/2015 | Abushaev | |
| 2017/0003101 | A1 | 1/2017 | Madrid et al. | |
| 2019/0041161 | A1 * | 2/2019 | Gregory | F41C 33/0209 |

FOREIGN PATENT DOCUMENTS

| | | |
|---|---|---|
| FR | 2893404 | 5/2007 |
| WO | WO98/40686 | 9/1998 |
| WO | WO2010/064268 | 6/2010 |
| WO | WO2013/071402 | 5/2013 |
| WO | WO2014/028876 | 2/2014 |
| ZA | 986778 | 2/1999 |

OTHER PUBLICATIONS

European Patent Office, Search Opinion of Application No. 10828676.6, dated Feb. 16, 2015, 3 pages.

European Patent Office, Supplementary Search Report of Application No. 10828676.6, dated Feb. 16, 2015, 2 pages.

Written Opinion of the International Searching Authority for International Application No. PCT/US2010/002935, dated Jan. 7, 2011.

PCT International Preliminary Report on Patentability for International Application No. PCT/US2010/002935, dated May 15, 2012, 5 pages.

PCT International Search Report for International Application No. PCT/US2010/002935, dated Jan. 7, 2011, 2 pages.

Notification of Transmittal of the International Search Report and the Written Opinion of the Int'l Searching Authority, Application No. PCT/US16/023474, dated Jul. 27, 2016, 20 pages.

Extended European Search Report Application No. 17184530.8 dated Nov. 23, 2017 (8 pgs.).

* cited by examiner

HOLSTER HAVING A REMOVABLE LOCKOUT ELEMENT

CROSS-REFERENCE TO RELATED APPLICATIONS

This application is a continuation of U.S. patent application Ser. No. 15/212,226, filed Jul. 16, 2016, which is a continuation of U.S. patent application Ser. No. 15/201,552, filed Jul. 4, 2016, now U.S. Pat. No. 10,088,273, issued on Oct. 2, 2018, which is a continuation of U.S. patent application Ser. No. 14/229,944, filed Mar. 30, 2014, now U.S. Pat. No. 9,383,165, issued on Jul. 5, 2016, which is a continuation of U.S. patent application Ser. No. 13/508,759, filed May 9, 2012, now U.S. Pat. No. 8,720,755, issued on May 13, 2014, which is a national stage entry of PCT/US2010/002935, filed Nov. 9, 2010, which claims priority to U.S. Application No. 61/335,856 filed Jan. 13, 2010 and U.S. Provisional Application No. 61/280,829, filed Nov. 9, 2009, all of which are incorporated herein in their entireties by reference.

BACKGROUND OF THE PRESENT DISCLOSURE

1. Field of the Present Disclosure

The present disclosure relates generally to handgun holsters. In particular, the present disclosure relates to a handgun holster having a lockable retention system.

2. Description of Related Art

Many users of handguns, particularly military and law enforcement personnel, carry a handgun in a holster designed to protect the handgun and hold it securely. Holsters can be worn in a number of ways, such as on a belt at the waist, on the thigh, under an arm, or around an ankle.

Certain users of handguns must be able to quickly and easily remove the handgun from a holster regardless of the type of holster used. Additionally, these users need to be assured that, when not in use, the handgun will remain safely in the holster.

Some holsters rely solely on friction to secure the handgun in place. This combination might not be suitable for situations where the gun/holster is subject to a great deal of movement because such movement could cause the handgun to lose frictional engagement with the holster.

Certain other holsters include a variety of strap or flap arrangements that prevent the removal of the firearm from the holster while the strap or flap is in place. With designs that rely on this method to retain a handgun, a user must first unfasten and/or rotate the strap/flap before the firearm can be withdrawn. Then, to re-secure the handgun in the holster once the handgun has been re-holstered, the user must physically refasten and/or rotate the strap/flap before the firearm is securely retained within the holster. Some users might not prefer these designs because of the time required to release and/or re-secure the handgun.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

SUMMARY OF THE PRESENT DISCLOSURE

The present disclosure relates generally to handgun holsters. In particular, the present disclosure relates to a holster for a weapon, such as, for example, a handgun, having a retention system for securing a handgun such that the handgun is retained or locked in the holster when the retention system is engaged, but may be easily removed from the holster by the wearer while removal by anyone other than the wearer is difficult.

In an illustrative, non-limiting embodiment of the present disclosure, the handgun holster comprises a handgun holster having a retention system. The retention system comprises a lever having an engagement portion and a finger button portion, the engagement portion includes a locking projection for engaging an interior portion of the trigger guard of the handgun in the holster and, thereby, retaining the handgun in the holster.

The construction of the holster prevents the locking projection from contacting the trigger of the handgun by limiting how far the handgun can be inserted into the holster. The construction of the holster further facilitates alignment of the trigger guard with the locking projection by limiting movement of the handgun with respect to the lever.

The lever is positioned on the holster such that, when a user depresses the appropriate portion of the lever, thereby releasing the handgun from the holster, and draws the handgun from the holster, the user's index finger is positioned to contact the frame of the handgun, above the trigger guard.

In an illustrative, non-limiting embodiment of the present disclosure, a biasing element is optionally included. If included, the biasing element contacts a front portion of the handgun's trigger guard and is spring-biased when the handgun is retained, or locked, in the holster. The biasing element biases the handgun out of the holster and assists in maintaining contact between the locking projection and the trigger guard. Furthermore, the biasing element may assist in removal of the handgun from the holster when the locking projection is disengaged from the trigger guard.

In one illustrative, non-limiting embodiment of the present disclosure, the holster includes an at least partial cavity having an open top end, a bottom end, a frame/slide portion, and a trigger guard portion. The frame/slide portion of the at least partial cavity has greater depth than the trigger guard portion of the at least partial cavity. An axis extends between the frame/slide portion of the at least partial cavity and the trigger guard portion of the at least partial cavity.

A lever having a finger button portion and an engagement portion is pivotally attached atop the side wall of the holster, along the axis, approximately between the finger button portion and the engagement portion, such that the finger button portion extends from the axis and is positioned above the frame/slide portion of the at least partial cavity and the engagement portion extends from the axis and is positioned above the trigger guard portion of the at least partial cavity.

The lever includes a second side facing generally toward the holster cavity, and the engagement portion of the lever includes a locking projection extending from the second side of the engagement portion; wherein the lever.

In certain illustrative, non-limiting embodiments of the present disclosure, the holster further includes at least one ridge segment extending from the side wall around at least a portion of the lever so as to define a recess. The lever is positioned within the recess and an aperture formed in a portion of the side wall beneath at least a portion of the finger button portion of the lever, wherein the aperture is formed within the recess.

Thus, the present disclosure automatically locks the handgun in place in the holster with a releasable mechanism that is easily operated by a wearer of the holster. However, the present mechanism is not easily accidentally disengaged or disengaged by anyone other than the wearer.

In certain illustrative, non-limiting embodiments, the holster of the present disclosure comprises an at least partial cavity; a lever having a finger button portion and an engagement portion, wherein the lever includes a locking projection extending from at least a portion of the engagement portion, wherein the lever is pivotally attached or coupled to at least a portion of the holster, approximately between the finger button portion and the engagement portion; and a lockout element, wherein at least a portion of the lockout element is positionable within at least a portion of the holster such that if at least a portion of the lockout element is positioned within at least a portion of the holster, at least a portion of the lockout element is positioned below at least a portion of the finger button portion to keep the lever from being pivoted to a disengaged position.

In various illustrative, non-limiting embodiments, wherein the lockout element is positionable within a lockout element aperture of the holster such when at least a portion of the lockout element is positioned within the lockout element aperture, at least a portion of the lockout element is positioned below at least a portion of the finger button portion to keep the lever from being pivoted to the disengaged position.

In certain illustrative, non-limiting embodiments, the lockout element extends from a portion of a lockout band. Optionally, the lockout element extends from a portion of a lockout band and wherein the lockout element portion of the lockout band is positionable within a lockout element aperture while a portion of the lockout band is positionable within a lockout band aperture formed within a portion of the holster.

In various illustrative, non-limiting embodiments, the holster of the present disclosure comprises an at least partial cavity having a frame/slide portion, and a trigger guard portion; a lever having a finger button portion and an engagement portion, wherein the lever includes a second side facing generally toward the at least partial cavity, wherein the engagement portion of the lever includes a locking projection extending from at least a portion of the second side of the engagement portion, wherein the lever is pivotally attached or coupled to at least a portion of the holster, approximately between the finger button portion and the engagement portion, and wherein the lever is pivotable between an engaged position and a disengaged position; at least one ridge segment extending from at least a portion of a side wall of the holster, around at least a portion of the lever so as to define a recess, wherein at least a portion of the engagement portion of the lever is positioned within at least a portion of the recess; and a lockout element, wherein at least a portion of the lockout element is slidably positionable through at least one lockout element aperture of the at least one ridge segment such that if at least a portion of the lockout element is positioned through the at least one lockout element aperture at least a portion of the lockout element blocks pivotable movement of the lever between the engaged position and the disengaged position.

In various illustrative, non-limiting embodiments, the holster of the present disclosure comprises an at least partial cavity; a lever having a finger button portion and an engagement portion, wherein the lever includes a locking projection extending from at least a portion of the engagement portion, wherein the lever is pivotally attached or coupled to at least a portion of the holster, approximately between the finger button portion and the engagement portion, and wherein the lever is pivotable between an engaged position and a disengaged position; and a lockout element, wherein at least a portion of the lockout element is positionable within at least a portion of the holster such that if at least a portion of the lockout element is positioned within at least a portion of the holster, at least a portion of the lockout element is positioned above at least a portion of the engagement portion of the finger button portion to keep the lever from being pivoted to a disengaged position.

Accordingly, the present disclosure provides a handgun holster, having a retention system.

The present disclosure separately and optionally provides a safe and reliable quick-release handgun holster.

The present disclosure separately and optionally provides a handgun holster having a retention system, which is capable of retaining a handgun securely in the holster while permitting a quick release of the handgun when the user requires.

The present disclosure separately and optionally provides a handgun holster having a retention system, which is simple to operate.

The present disclosure separately and optionally provides a handgun holster having a retention system, which automatically secures the handgun in the holster upon seating of the handgun in the holster, without requiring any additional operation by the user.

The present disclosure separately and optionally provides a handgun holster and a retention system that assists the user in positioning his or her index finger along the frame of the handgun, outside of and not on the trigger guard, as the handgun is drawn from the holster.

The present disclosure separately and optionally provides a handgun holster having an optional passive retention system, which can be tightened to provide increased frictional tension between a portion of the holster and the handgun trigger guard without increasing the frictional tension between a remaining portion of the holster and the handgun.

The present disclosure separately and optionally provides a handgun holster, which is capable of being manufactured using injection molding production techniques.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS

Figure 1:
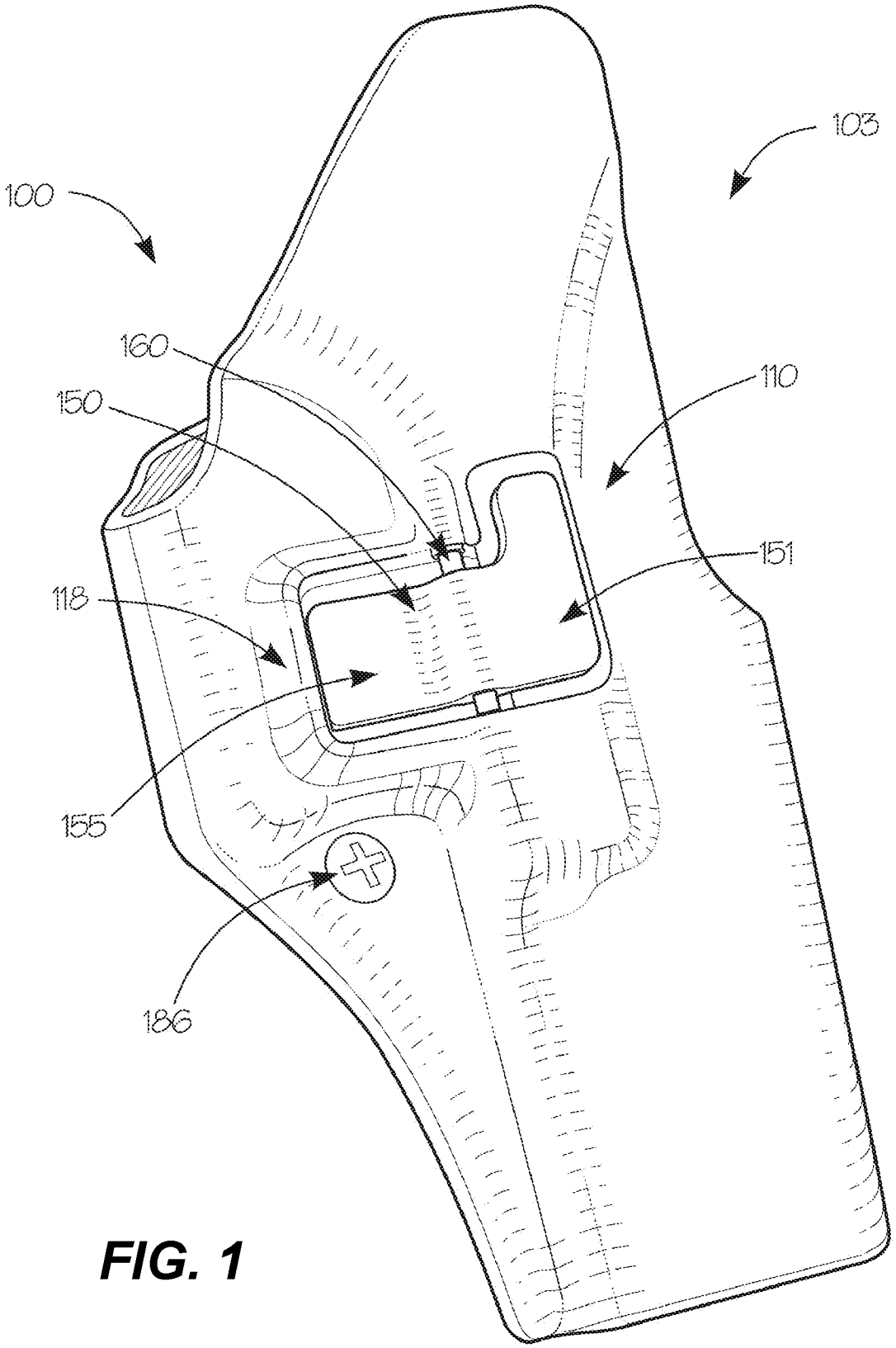
FIG. 1 shows a right perspective view of a first exemplary embodiment of a handgun holster having a retention system according to the present disclosure.
Figure 2:
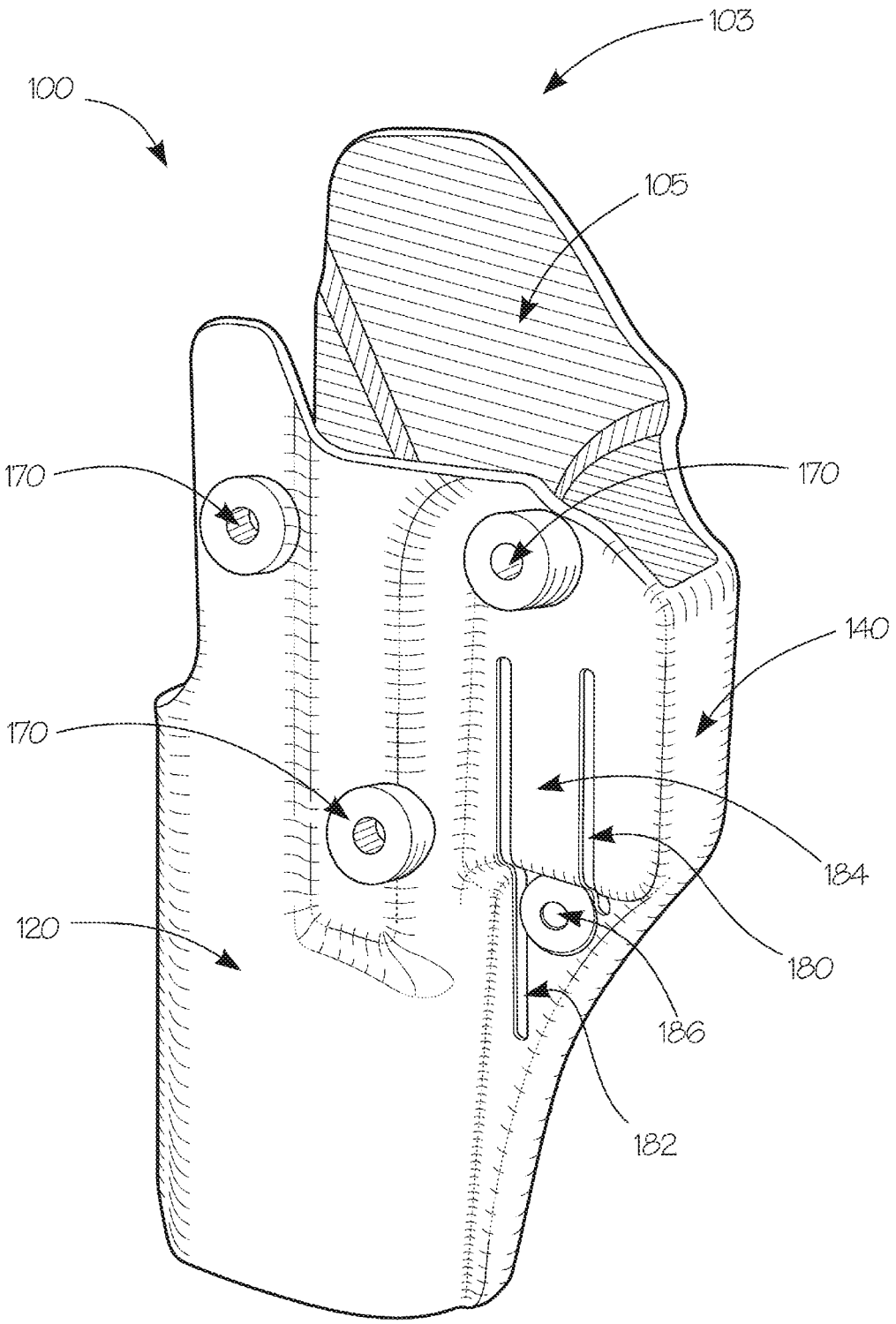
FIG. 2 shows a left perspective view of a first exemplary embodiment of a handgun holster having a retention system according to the present disclosure.

For simplicity and clarification, the design factors and operating principles of the handgun holster according to the present disclosure are explained with reference to various exemplary embodiments of a handgun holster according to the present disclosure. The basic explanation of the design factors and operating principles of the handgun holster is applicable for the understanding, design, and operation of the handgun holster of the present disclosure.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled" is defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are open-ended linking verbs. As a result, a system, device, or apparatus that "comprises", "has", "includes", or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Furthermore, it should be appreciated that, for simplicity and clarification, the embodiments of the present disclosure will be described with reference to a semiautomatic-type handgun being secured within the present holster. However, it should be appreciated that the operating principles of the handgun holster of the present disclosure may also be employed to construct holsters or holders for any revolver or semiautomatic-type handgun, edged weapons as well as less than lethal products (i.e., tasers, pepper spray, mace canisters, or batons), so long as these items have an appropriate ledge or void that may be engaged or retained by a locking projection or other retaining means. Furthermore, it is also within the scope of the present disclosure that the present holster may be employed as a pouch for tactical accessories, such as ammunition magazines and/or flashlights, as well as for everyday items such as cell phones or personal digital assistants.

It should also be appreciated that the terms "handgun", "handgun holster", and "weapon" are used for basic explanation and understanding of the operation of the systems, methods, and apparatuses of the present disclosure. Therefore, the terms "handgun", "handgun holster", and "weapon" are not to be construed as limiting the systems, methods, and apparatuses of the present disclosure.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing Figs., FIGS. 1-9B show various views of a first, illustrative, non-limiting embodiment of a handgun holster 100 having a retention system according to the present disclosure. It should be appreciated that the holster 100 is adapted to retain a semiautomatic-type handgun. The semiautomatic-type handgun includes a slide, a grip, a trigger, and a trigger guard. The trigger guard includes an inner surface, which defines an area wherein the trigger is located and allows a user's finger access to the trigger, and an outer surface, which defines the outer perimeter of the trigger guard.

As shown in FIGS. 1-9B, the holster 100 includes a body 103 defining an at least partial cavity 105 for receiving and holding the handgun. The body 103 comprises a pair of opposed side walls comprising a first side wall 110 and a second side wall 120. Typically, the first side wall 110 is considered the outer side of the holster and is worn away from the user's body, while the second side wall 120 is considered the inner side of the holster and is worn against or adjacent the user's body.

In various exemplary embodiments, the body 103 further comprises at least some of a front wall 130 and a rear wall 140. However, it should be appreciated that the holster 100 may be formed such that one or more of the first side wall 110, the second side wall 120, the front wall 130, and/or the rear wall 140 is/are sufficient to define the at least partial cavity 105 for receiving the handgun and the remaining walls are not included.

The at least partial cavity 105 includes an open top end 101 and a bottom end 102 and may be formed from any number or combination of walls, including, for example, a single, continuous wall or multiple coupled or joined walls. Alternatively, the at least partial cavity 105 may be formed by a material being shaped or bent in a substantial "U" shape. Thus, the at least partial cavity 105 may be formed by any cavity, space, or platform that is capable of retaining a handgun.

Figure 3:
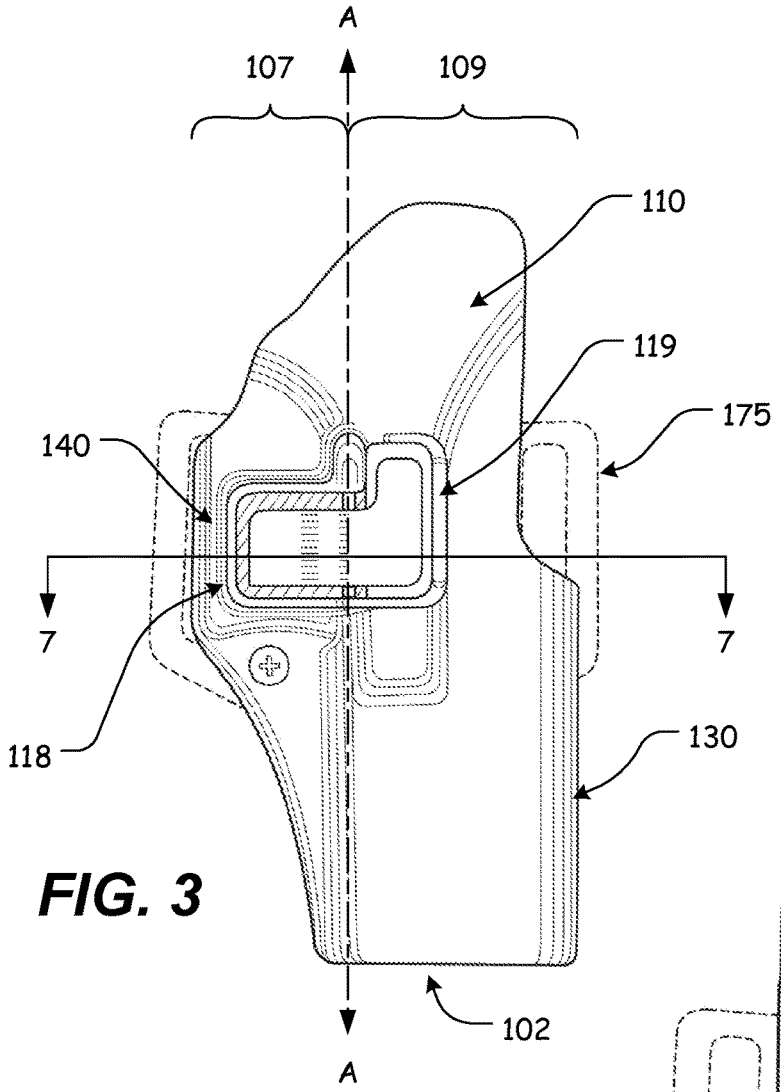
FIG. 3 shows a right side elevation view of a first exemplary embodiment of a handgun holster having a retention system according to the present disclosure.

As identified in FIG. 3, an axis A extends generally from the top end 101 to the bottom end 102, between a frame/slide portion 109 of the at least partial cavity 105 and a trigger guard portion 107 of the at least partial cavity 105. The frame/slide portion 107 of the at least partial cavity 105 generally has greater depth than the trigger guard portion 109 of the at least partial cavity 105.

It should be noted that the walls of the holster 100 may generally be planar. Alternatively, the walls of the holster 100 may be contoured or shaped to better accommodate a specific type or model of handgun to be retained within the holster 100.

In various exemplary embodiments, the holster 100 is substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

In various exemplary embodiments, at least certain components of the holster 100 may be formed of any known or later developed, substantially flexible material(s) such as a polymeric material, leather, foam, foam laminates, natural and man-made (synthetic) fabrics, natural and man-made (synthetic) fabric laminates, moldable honeycomb materials, or the like, and/or various combinations of the foregoing.

Thus, it should be understood that the material or materials used to form the holster 100 and/or various components of the holster 100 is a design choice based on the desired appearance and functionality of the holster 100.

Figure 4:
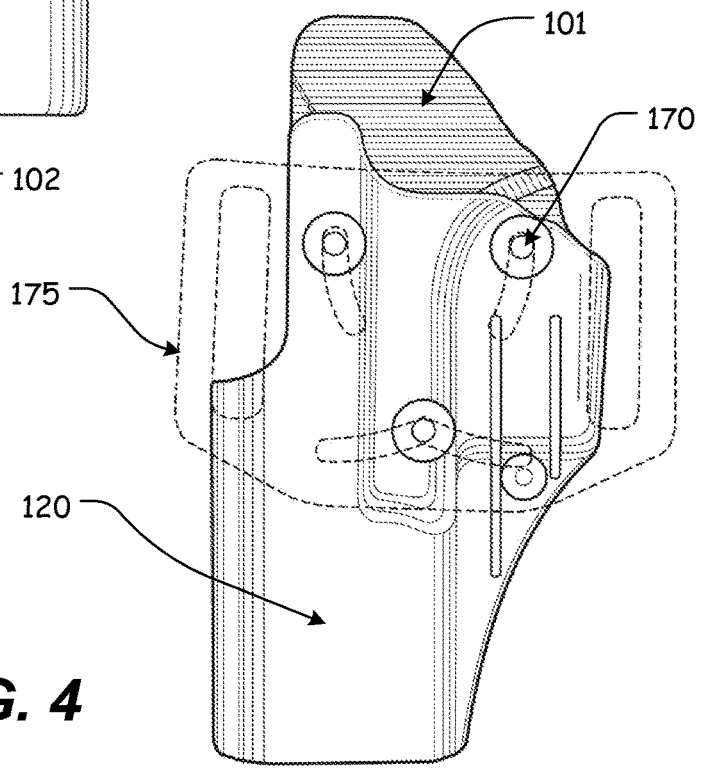
FIG. 4 shows a left side elevation view of a first exemplary embodiment of a handgun holster having a retention system according to the present disclosure.
Figure 5:
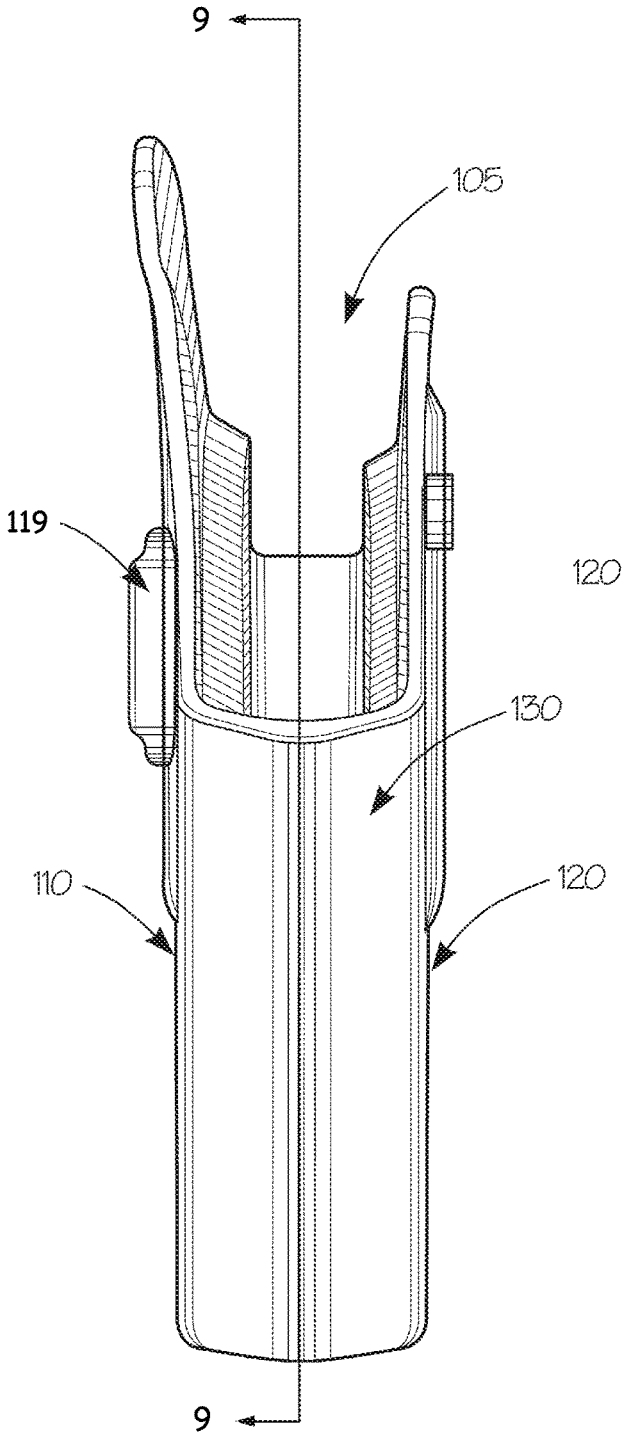
FIG. 5 shows a front elevation view of a first exemplary embodiment of a handgun holster having a retention system according to the present disclosure.
Figure 6:
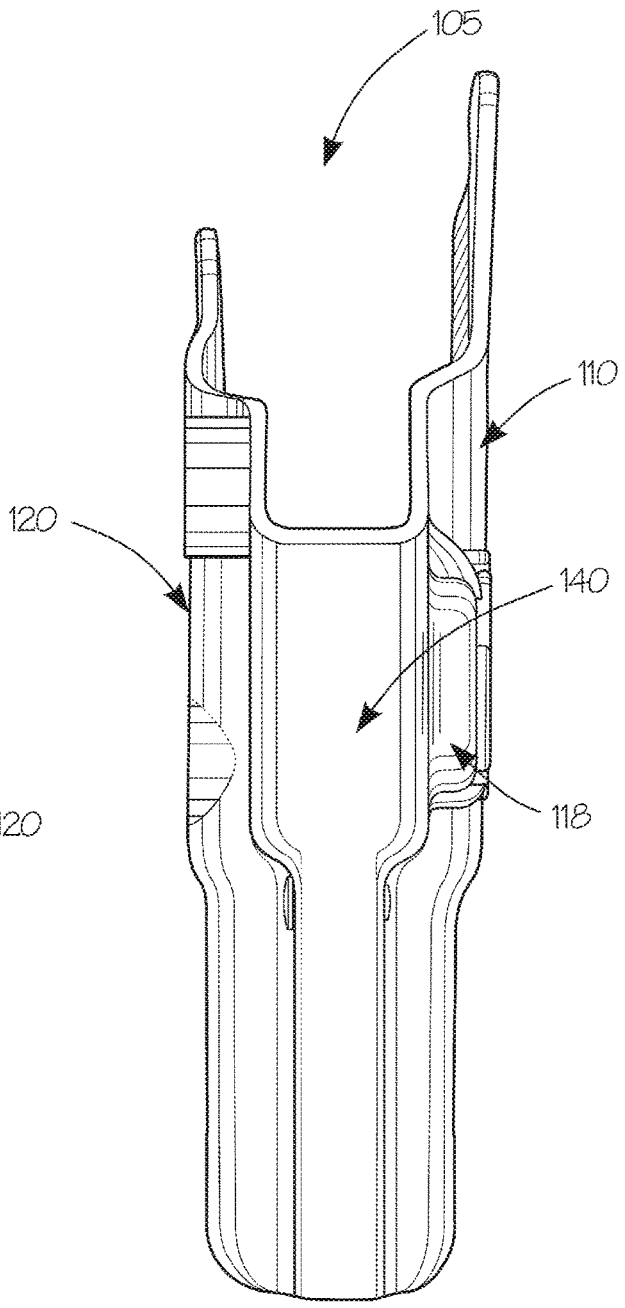
FIG. 6 shows a rear elevation view of a first exemplary embodiment of a handgun holster having a retention system according to the present disclosure.
Figure 7:
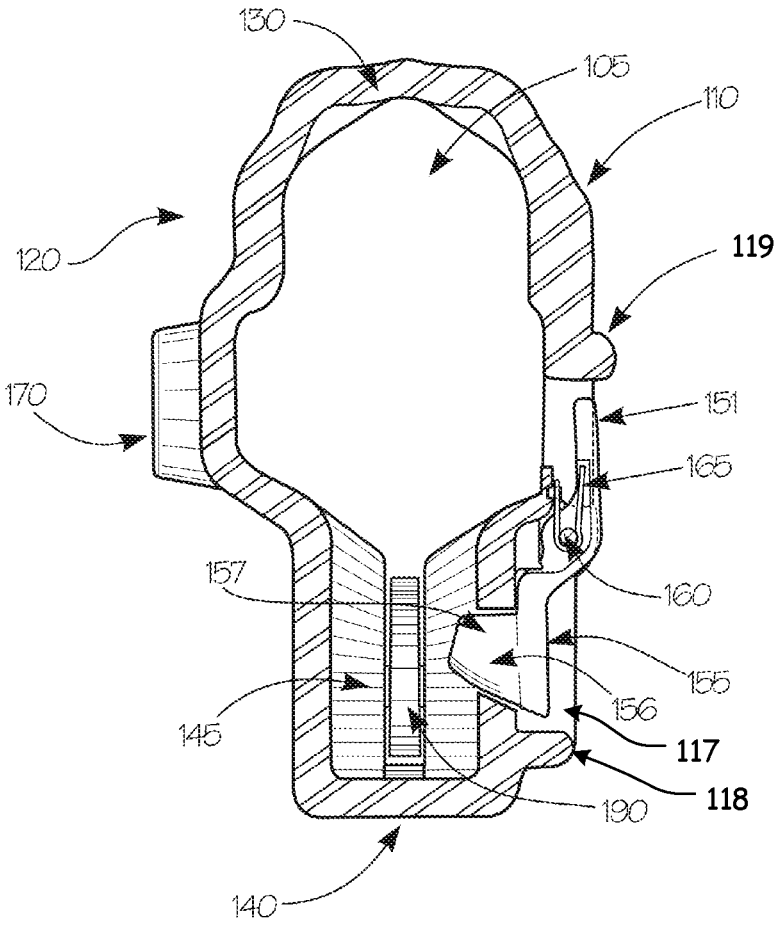
FIG. 7 shows a top cross-sectional view taken along line 7-7 of the handgun holster of FIG. 3, illustrating the first exemplary embodiment of the retention system according to the present disclosure in greater detail.
Figure 8:
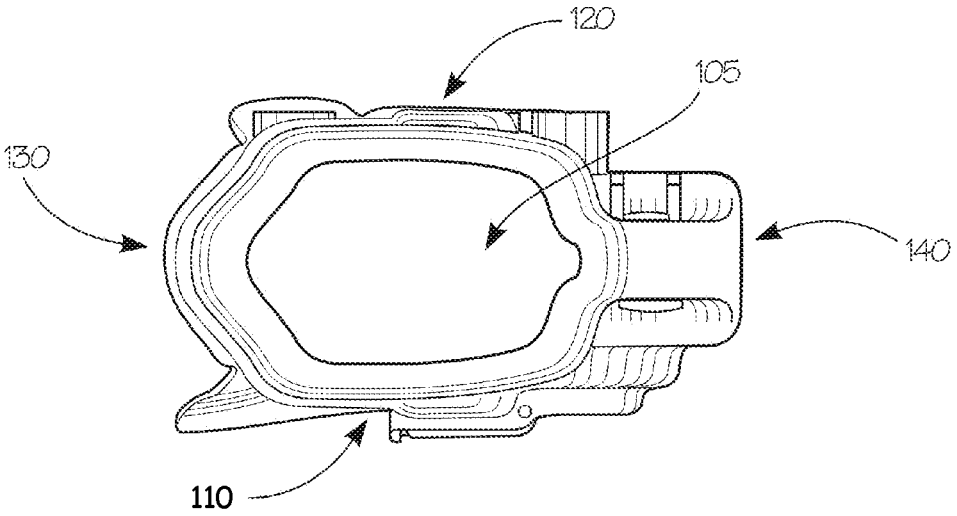
FIG. 8 shows a bottom plan view of a first exemplary embodiment of a handgun holster having a retention system according to the present disclosure.
Figure 9A:
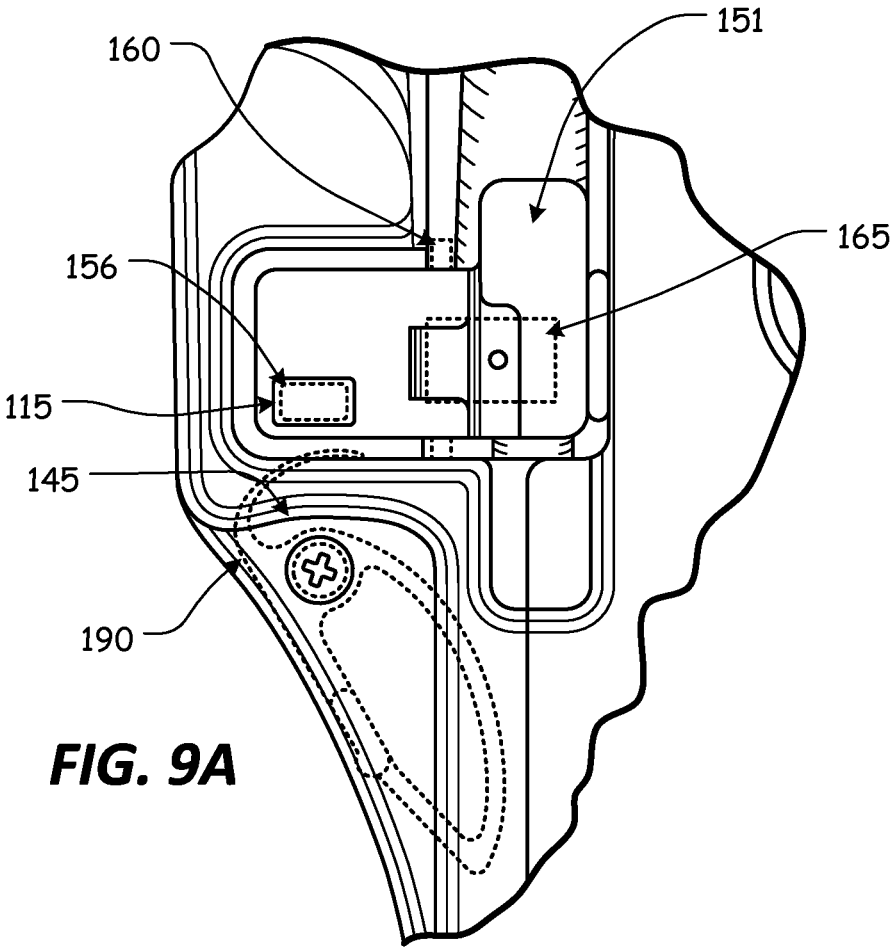
FIG. 9A shows a more detailed right side view of the handgun holster further illustrating the retention system according to the present disclosure.
Figure 9B:
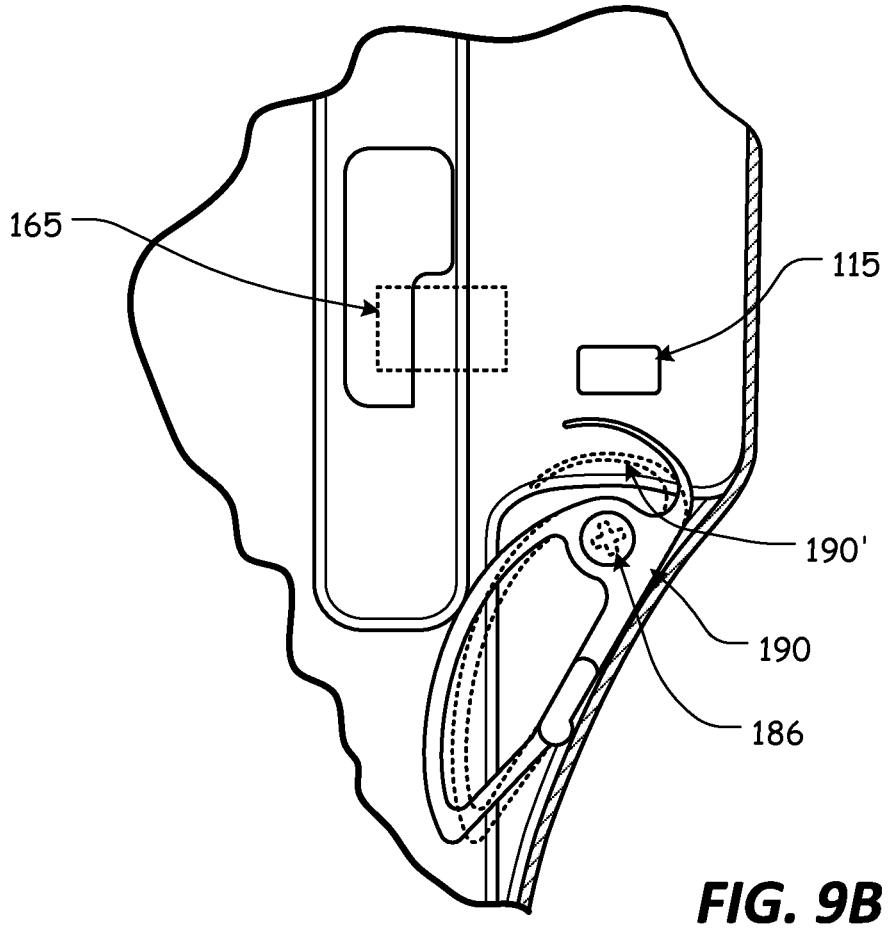
FIG. 9B shows a more detailed cross-sectional view taken along line 9-9 of the handgun holster of FIG. 5, illustrating the first exemplary embodiment of the retention system according to the present disclosure in greater detail.

In various exemplary embodiments, the holster 100 includes attachment points 170, which provide means for fastening the holster to a holster holding device such as the holster holding device 175 illustrated in phantom in FIGS. 3 and 4. Alternatively, the means for fastening the holster may comprise a clip or hook adapted to be clipped over, for example, a belt. In further exemplary embodiments, means for fastening the holster may comprise one or more quick-disconnect or other couplings may be provided on or adjacent the second side wall 120 of the holster 100, which may be permanently or removably coupled to corresponding and cooperating coupling(s) provided on a belt or other carrier or platform. In still other exemplary embodiments, the holster 100 may comprise an integral belt, or may comprise one or more connections for attachment to a chest, ankle, leg, shoulder, or other harness or band, or for otherwise securing the holster to a user or the user's apparel.

In various exemplary embodiments, one or both of the side walls include optional slots 180 and 182, which define a passive retention portion 184. Although not shown in the present figures, the inner surface of the passive retention portion 184 may optionally include a raised area, which provides for additional frictional engagement of the trigger guard of the handgun. One or more retention screws 186 may be tightened or loosened to adjust the degree of frictional retention of the handgun by the passive retention portion 184.

The passive retention portion 184, if included, may be adjusted, via the one or more retention screws 186, to provide an adjustable frictional tension between the passive retention portion 184 and the handgun trigger guard, without increasing the frictional tension between a remaining portion of the holster 100 and the handgun.

As further shown in FIGS. 1-9B, the holster 100 comprises a retention means that is capable of retaining a handgun securely in the holster 100 by restricting withdrawal of the handgun from the at least partial cavity 105 of the holster 100 while permitting a quick release of the handgun when the user requires. The retention means comprises a lever 150, having a first side facing generally outward from the holster 100, away from the at least partial cavity 105 formed by the holster 100, and a second side facing toward the at least partial cavity 105 formed by the holster 100. The lever 150 comprises at least some of a finger button portion 151 and an engagement portion 155.

In various exemplary embodiments, the first side of the finger button portion 151 includes a textured portion (not shown). In this manner, the finger button portion 151 may be distinguished tactilely from other portions of the lever 150 or the holster 100.

In various exemplary, non-limiting embodiments, lever 150 is pivotally connected to the first side wall 110, approximately between the finger button portion 151 and the engagement portion 155, via a fulcrum or pivot pin 160. In various exemplary embodiments, the pivot pin 160 is positioned substantially parallel to a vertical axis of the holster 100, substantially perpendicular to a vertical axis of the holster 100, at a substantially acute angle relative to a vertical axis of the holster 100, or at a substantially obtuse angle relative to a vertical axis of the holster 100. Thus, the pivot pin 160 may be positioned at any angle relative to a vertical axis of the holster 100.

The pivot pin 160 may extend all or part of the way across the width of the lever 150.

In various exemplary embodiments, the lever 150 may include a first and a second protrusion extending from the lever 150. Corresponding first and second indentions, indentations, notches, grooves, or dimples may be formed in the first side wall 110. In these exemplary embodiments, the first and second protrusions are formed so as to operate in cooperating relationship with the first and second dimples such that the lever 150 may be pivotally attached, via the first and second protrusions and the first and second dimples, to the first side wall 110 approximately between a finger button portion 151 and the engagement portion 155. Thus, the pivot pin 160 is replaced by the first and second protrusions.

Alternatively, the lever 150 may include first and second dimples while the first sidewall 110 includes first and second protrusions. In these exemplary embodiments, the first and second dimples are formed so as to operate in cooperating relationship with the first and second protrusions such that the lever 150 may be pivotably attached, via the first and second dimples and the first and second protrusions, to the first side wall 110 approximately between the finger button portion 151 and the engagement portion 155.

The lever 150 is pivotable between an engaged position for securing the handgun within the at least partial cavity 105 of the holster 100 and a disengaged position for removal of the handgun. In various exemplary embodiments, the lever 150 may pivot between the engaged position and the disengaged position. Alternatively, the lever 150 may be pivotably positioned and/or retained between either the engaged position or the disengaged position.

In various exemplary embodiments, the lever 150 may be biased to an engaged position whether the handgun is present in the holster 100 or absent from the holster 100. In various exemplary embodiments, biasing of the lever 150 may be accomplished by, for example, a spring means 165.

It should be appreciated that any suitable biasing means, element, or mechanism may be used to form the spring means 165. For example, in various illustrative, non-limiting embodiments of the present disclosure, the spring means 165 may comprise a portion of spring steel, a helical spring, a compression coil spring, a cylindrical coil spring, a conical coil spring, a tension coil spring, a leaf spring, a V-spring, a cantilever spring, a spring washer, a flexible extension of the lever 150 or the first side wall 110, a stretched or tensioned material, such as, for example, a rubber band, or any other element, material, or mechanism usable to bias the lever 150.

It should be understood that the overall size, shape, and thickness of the spring means 165 will vary depending on the type and rigidity of the particular material used to form the spring means 165.

The engagement portion 155 of the lever 150 includes a locking projection 156, formed on the second side of the engagement portion 155. In certain exemplary embodiments, the locking projection 156 optionally extends substantially perpendicularly from the second side of the engagement and 155.

In various exemplary, nonlimiting embodiments, the locking projection 156 includes a ramp surface 157 and is shaped generally to match the contour of a portion of the inner surface of the trigger guard. Alternatively, the locking projection 156 may terminate in a radiused or not radiused manner. Particularly if the trigger guard of the handgun that is to be carried within the holster 100 is itself radiused, the ramp surface 157 may not be included.

Regardless of the particular handgun used, the locking projection 156 should be shaped so that there is no possibility that the locking projection 156 can at any time contact the trigger of the handgun. When the handgun is pushed as far forward as possible into the holster 100 and the trigger guard has come to rest against the trigger guard support wall 145, there should be a space between the locking projection 156 and the trigger of the handgun.

When the lever 150 is in the engaged position, the locking projection 156 protrudes from the second side of the engagement portion 155, into the at least partial cavity 105 formed in the holster 100, via an opening 115 in the first side wall 110. In this manner, the locking projection 156 may extend inside the at least partial cavity 105 and inside the trigger guard of a handgun that is placed into the holster 100 and, thereby, retain the handgun in the holster 100.

In various exemplary embodiments, the locking projection 156 protrudes into the at least partial cavity 105 for a distance that is less than the width of the trigger guard. Alternatively, the locking projection 156 may protrude into the at least partial cavity 105 for a distance that is equal to or greater than the width of the trigger guard.

In addition, when the lever 150 is in the engaged position and is retaining a handgun in place, the clearance between the locking projection 156 and the trigger guard support wall 145 should be such that there is room for the slight arc or plunger-type movement of the locking projection 156 when the finger button portion 151 is depressed.

Thus, the retention means is automatically disengaged as the outer surface of the handgun's trigger guard contacts the locking projection 156 and is subsequently engaged when the inner surface of the trigger guard has passed the locking projection 156 and the handgun is appropriately retained in the holster 100.

As illustrated in FIGS. 1 and 3, the holster 100 can be divided, along an axis that extends from the pivot pin 160, along the first side wall 110 of the holster 100, into a frame/slide portion and a trigger guard portion. The frame/slide portion is contoured to accept at least a portion of a frame/slide of a handgun and the trigger guard portion is contoured to accept at least a portion of a trigger guard of a handgun. Thus, it can be seen that the finger button portion 151 extends into the frame/slide portion of the holster and the engagement portion 155 extends into the trigger guard portion of the holster 100.

As at least a portion of each holster 100 is formed to accommodate and securely retain a specific type of handgun. The construction of the holster 100 also prevents the locking projection 156 from contacting the trigger of the inserted handgun by limiting how far the handgun can be inserted into the holster 100.

In various exemplary embodiments, a trigger guard support wall 145 is generally formed by a portion of the body of the holster 100. The trigger guard support wall 145 is shaped generally to match the contours of at least a portion of the outer surface of the trigger guard. The trigger guard support wall 145 is formed so as to contact at least a portion of the outer surface of the trigger guard of the inserted handgun and further limit how far the handgun can be inserted into the holster 100.

The construction of the holster 100 further facilitates alignment of the trigger guard with the locking projection 156 by limiting lateral movement of the handgun with respect to the lever 150 and the locking projection 156 without preventing a user from easily holstering or drawing the handgun.

In various exemplary embodiments, an optional ridge 118 is formed in the first side wall 110 around at least a portion of the lever 150. Generally, the ridge does not contact the lever 150, but provides a perimeter around at least a portion of the lever 150 to reduce the likelihood that the lever 150 will be inadvertently manipulated and to aid in the proper placement of a user's finger on the finger button portion 151 of the lever 150. The ridge 118 may include a textured portion (not shown), such that the ridge 118 may be distinguished tactilely from other portions of the holster 100 or the lever 150. The ridge 118 may include a gap or valley formed so as to accommodate a user's finger if the finger would extend beyond the finger button portion 151 of the lever 150.

In various exemplary embodiments, the optional ridge 118 is comprised of at least one ridge segment 118 and/or 119 that are formed around at least a portion of the lever 150.

In various exemplary embodiments, a recess 117 is defined within the optional ridge 118 or ridge segments 118 and/or 119.

Although FIGS. 1-9B show the lever 150 connected to the first side wall 110, it should be appreciated that in various exemplary embodiments, the lever 150 may be connected to the second side wall 120.

In an illustrative, non-limiting embodiment of the present disclosure, a biasing element 190 is optionally included. If included, the biasing element 190 extends towards the locking projection 156, covering substantially the entire distance between the trigger guard support wall 145 and the locking projection 156. In various exemplary embodiments, the biasing element 190 does not touch the locking projection 156.

It should be appreciated that any suitable spring mechanism may be used to form the biasing element 190. The overall size, shape, and thickness of the biasing element 190 will vary depending on the type and rigidity of the particular material used to form the biasing element 190.

The biasing element 190 is configured to contact the outer surface of the trigger guard and is spring-biased (as shown in phantom by 190') when the handgun is retained, or locked, in the holster. In a compressed position, the tension of the biasing element 190 biases the handgun outward and assists in maintaining contact between the locking projection 156 and the inner surface of the trigger guard. The biasing portion 190 further comprises an arcuate spring mechanism extending toward the front wall into the frame slide portion of te cavity.

Furthermore, the biasing element 190 may assist in removal of the handgun from the holster when the locking projection is disengaged from the trigger guard.

The biasing element 190 may be configured in a number of ways, and may be attached to the holster 100 by any suitable method. In one exemplary embodiment, the biasing element 190 is molded as an integral part of the holster 100.

An aperture 116 is formed in a portion of the first side wall 110, within the recess 117, beneath at least a portion of the finger button portion 151 of the lever 150. Among other things, the aperture 116 allows dirt and/or debris that may find its way under the finger button portion 151 of the lever 150 to be pushed into the at least partial cavity 105. In this manner, dirt and/or debris is not permitted to build up underneath the finger button portion 151 of the lever 150 and keep the finger button portion 151 from being depressed by a user.

During use of the holster 100 having a retention system, as a user begins to holster the handgun, the handgun is inserted into the at least partial cavity 105 of the holster, muzzle first, and is guided into position by at least some of the first side wall 110, the second side wall 120, the front wall 130, and the rear wall 140.

As the handgun is inserted further into the at least partial cavity 105, the outer surface of the trigger guard will contact the ramp surface 157 of the locking projection 156. The shape of the ramp surface 157 allows the locking projection 156 to ride along the surface of the trigger guard and displace the locking projection 156 of the lever 150. As the locking projection 156 rides along the surface of the trigger guard, the bias of the lever 150 is overcome and the lever 150 is pivoted towards the disengaged position and the handgun is permitted to be seated in the at least partial cavity 105 of the holster. The trigger guard is prevented from moving in a direction opposite the locking projection 156 by the position of the first side wall 110 and the second side wall 120.

As the handgun is further seated into the holster, the trigger guard continues to displace the locking projection 156 and the lever 150 continues to pivot until the trigger guard passes a point of contact with a farthest extent of the locking projection 156 and clears the locking projection 156. When the trigger guard passes the locking projection 156, the lever 150 may be biased, via the spring means 165, to pivot back to the engaged position.

Thus, the handgun is secured in the at least partial cavity 105 of the holster by operation of the locking projection 156 blocking removal of the handgun, via the inner surface of the trigger guard. While the handgun is fully seated in the at least partial cavity 105 of the holster 100 with the lever 150 biased to the engaged position, removal of the handgun is not permitted, as the locking projection 156 does not allow the trigger guard to pass by. When the handgun is secured in place, removal force applied to the handgun will not remove the handgun from the holster 100 unless the finger button portion 151 is pivoted and the locking projection 156 is brought out of the way of the inner surface of the trigger guard.

In order to release and unholster the handgun, the user depresses the finger button portion 151 of the lever 150, pivoting the finger button portion 151 towards the at least partial cavity 105. At some point, the first side wall 110 will stop the inward movement of the finger button portion 151, thus eliminating the possibility that the finger button portion 151 can prevent the removal of the handgun by contacting the trigger or constricting the trigger guard.

As the finger button portion 151 of the lever 150 is depressed, the bias of the lever 150 is overcome, the lever 150 is pivoted towards the disengaged position, and the locking projection 156 of the engagement portion 155 is at least partially withdrawn from the opening 115 and out of the holster cavity 105.

When the finger button portion 151 has been depressed sufficiently, such that the locking projection 156 of the engagement portion 155 is sufficiently withdrawn from the holster cavity 105, such that the locking projection 156 clears the inner surface of the trigger guard, the handgun's trigger guard will no longer be blocked by the locking projection 156, and the handgun can be withdrawn from the holster 100.

In various exemplary embodiments wherein the first side wall 110 is worn away from the user's body and the second side wall 120 is worn adjacent the user's body, the finger button portion 151 may be positioned such that, as the finger button portion 151 is depressed, the user's index finger is positioned along the frame of the handgun, between the trigger guard and the slide. Therefore, as the handgun is withdrawn from the holster 100 the user's index finger is positioned to contact the frame of the handgun, above the trigger guard, and not the trigger guard or the trigger.

The holster 100, as shown and described with reference to FIGS. 1-9B, is oriented such that the first side wall 110 is worn away from the user's body and the second side wall 120 is worn adjacent the user's body, such that the lever 150 is generally accessible by the user's index finger. However, in various other exemplary embodiments, the first side wall 110 is oriented to be worn adjacent the user's body and the second side wall 120 is oriented to be worn away from the user's body. In these exemplary embodiments, the lever 150 is generally accessible by the user's thumb.

Figure 10A:
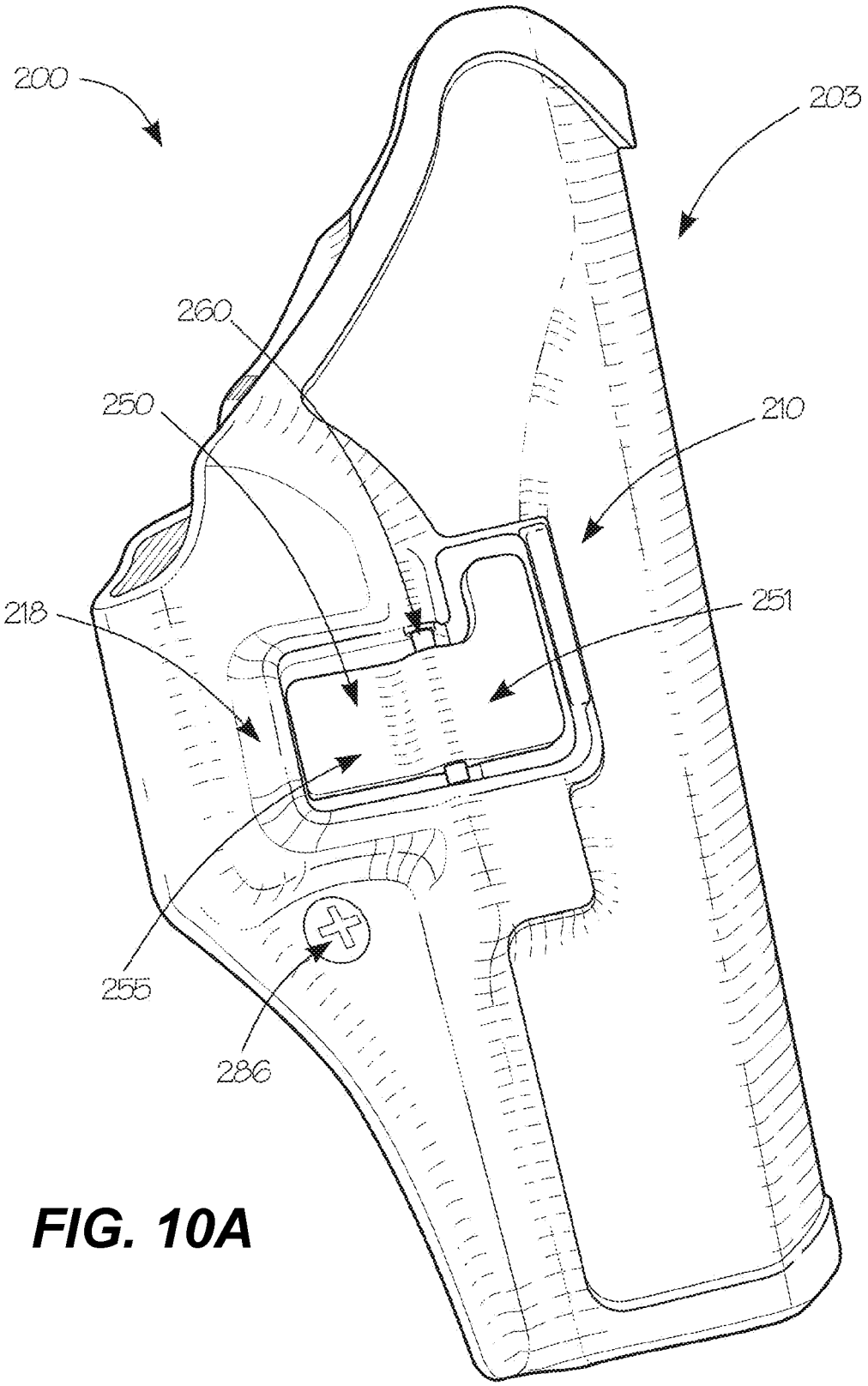
FIG. 10A shows a right perspective view of a second exemplary embodiment of a handgun holster having a retention system according to the present disclosure.
Figure 10B:
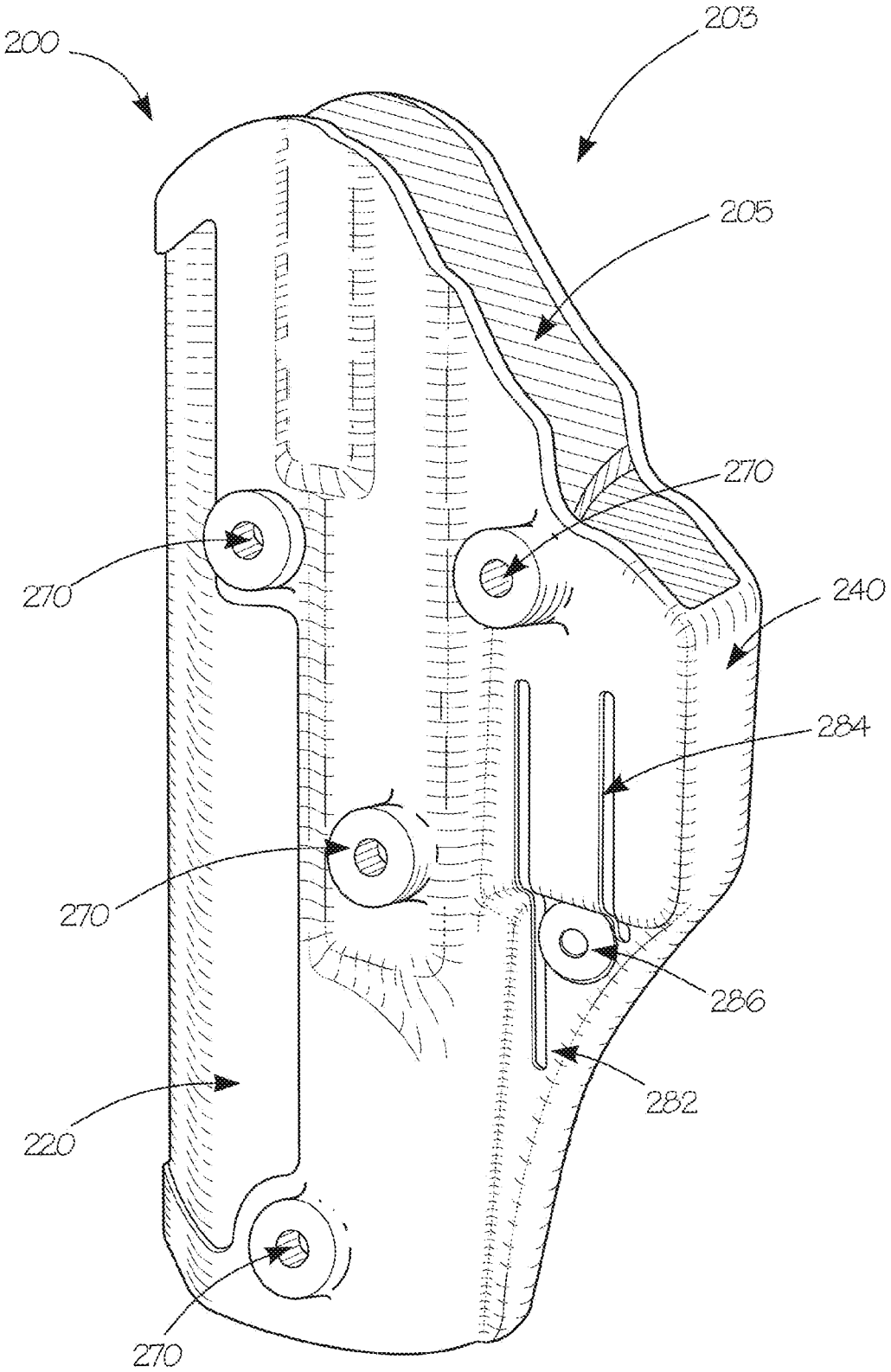
FIG. 10B shows a left perspective view of a second exemplary embodiment of a handgun holster having a retention system according to the present disclosure.

FIGS. 10A and 10B show a right perspective view and a left perspective view, respectively, of a second exemplary embodiment of a handgun holster 200 having a retention system according to the present disclosure. As shown in FIGS. 10A and 10B, the handgun holster 200 includes a body 203 defining an at least partial cavity 205 for receiving and holding the handgun. The body 203 comprises a pair of opposed side walls comprising a first side wall 210, an optional ridge 218 and/or ridge segments 218 and/or 219, a second side wall 220, a front wall 230, and a rear wall 240. The handgun holster 200 further comprises attachment points 270, optional slots 284 and 282, a passive retention screw 286, and a retention means comprising a lever 250.

It should be understood that each of these elements corresponds to and operates similarly to the body 103, the at least partial cavity 105, the first side wall 110, the optional ridge 118 and/or ridge segments 118 and/or 119, the second side wall 120, the front wall 130, the rear wall 140, the attachment points 170, the optional slots 180 and 182, the passive retention screw 186, the retention means, and the lever 150, as described above with reference to FIGS. 1-9B.

However, as shown in FIGS. 10A and 10B, the first side wall 210, the second side wall 220, and the front wall 230 of the handgun holster are extended, as compared to the holster 100.

The extended first side wall 210, second side wall 220, and front wall 230 perform at least three functions. First, the extended walls more fully surround and protect the handgun when the handgun is secured in the holster 200. Second, the extended walls serve to help better guide a handgun into the holster 200. Third, the extended walls serve to add a measure of strength and rigidity to the entire structure of the holster 200.

Figure 11A:
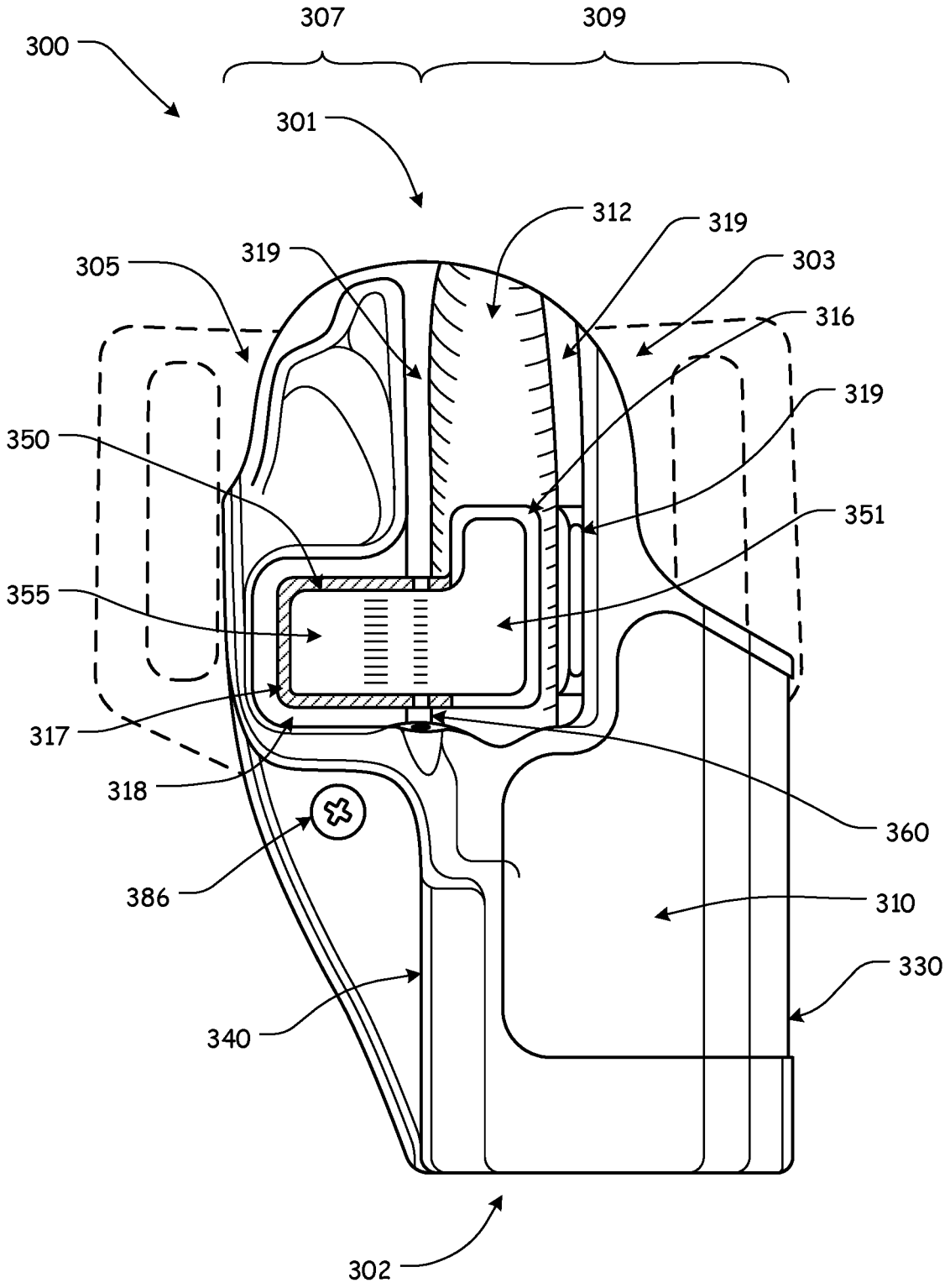
FIG. 11A shows a right side elevation view of a third exemplary embodiment of a handgun holster having a retention system according to the present disclosure.
Figure 11B:
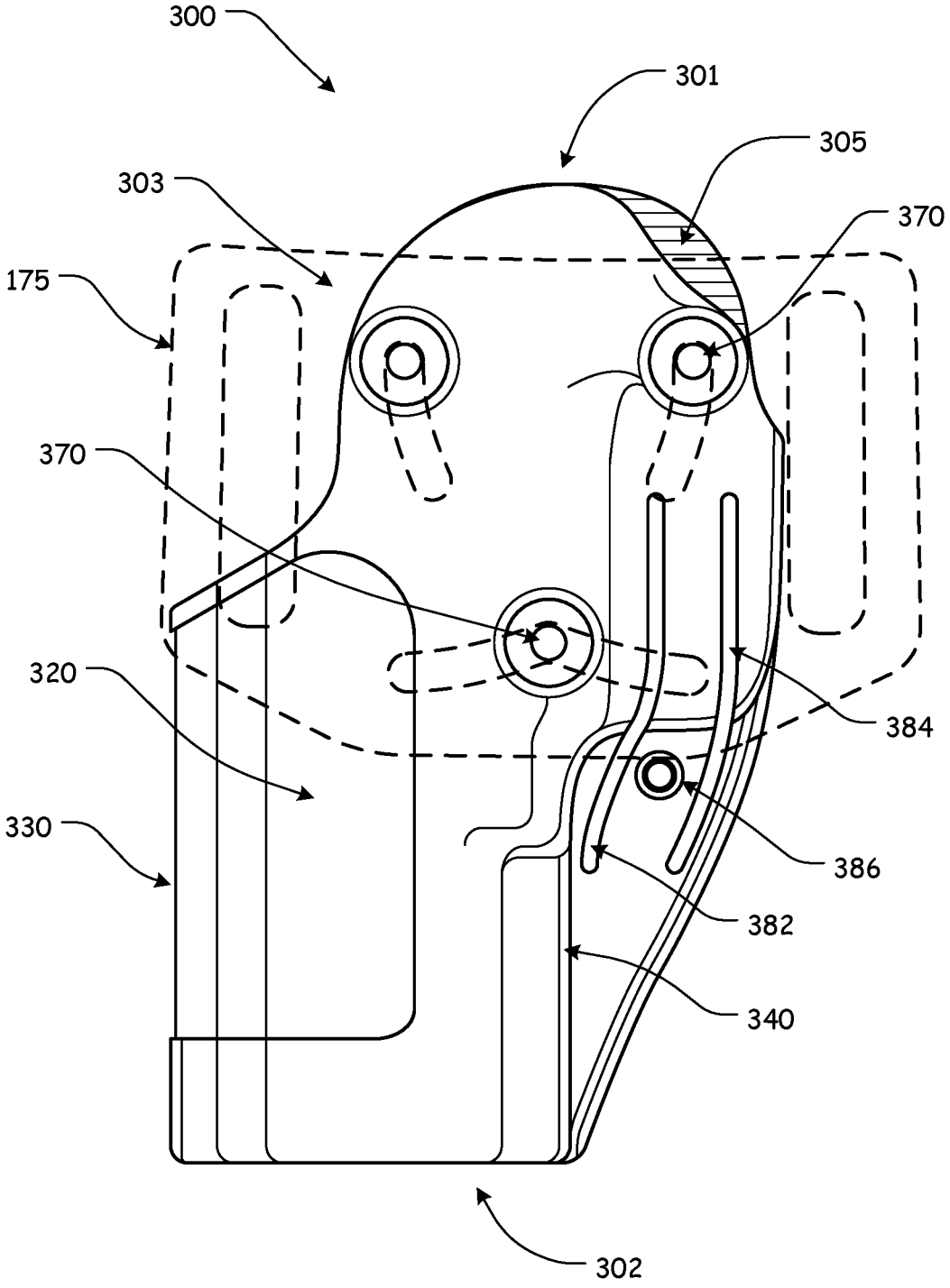
FIG. 11B shows a left side elevation view of a third exemplary embodiment of a handgun holster having a retention system according to the present disclosure.

FIGS. 11A and 11B show a right perspective view and a left perspective view, respectively, of a second exemplary embodiment of a handgun holster 300 having a retention system according to the present disclosure. As shown in FIGS. 11A and 11B, the handgun holster 300 includes an open top end 301 and a bottom end 302. The handgun holster 300 further includes a body 303 defining an at least partial cavity 305 (having a trigger guard portion 307 and a frame/slide portion 309) for receiving and holding the handgun.

The body 303 comprises a pair of opposed side walls comprising a first side wall 310, an aperture 316, a recess 317, an optional ridge 318 and/or ridge segments 318 and/or 319, a second side wall 320, a front wall 330, and a rear wall 340. The handgun holster 300 further comprises attachment points 370, optional slots 384 and 382, a passive retention screw 386, optionally the biasing element 390, and a retention means comprising a lever 350 having a finger button portion 351 and an engagement portion 355. The lever 350 is pivotally connected, via a pivot pin 360, to the first side wall 310.

It should be understood that each of these elements corresponds to and operates similarly to the body 103 and/or 203, the at least partial cavity 105 and/or 205, the first side wall 110 and/or 210, the aperture 116 and/or 216, the recess 117 and/or 217, the optional ridge 118 and/or 218, the optional ridge segments 118 and/or 119 and/or 218 and/or 219, the second side wall 120 and/or 220, the front wall 130 and/or 230, the rear wall 140 and/or 240, the pivot pin 160 and/or 260, the attachment points 170 and/or 270, the optional slots 180 and 182 and/or 280 and 282, the passive retention screw 186 and/or 286, the retention means, the optional biasing element 190 and/or 290 (not shown), and the lever 150 and/or 250 having the finger button portion 151 and/or 251 and the engagement portion 155 and/or 255, as described above with reference to FIGS. 1-10B.

However, as shown in FIGS. 11A and 11B, the first side wall 310, the second side wall 320, and the front wall 330 of the handgun holster 300 are slightly different from the respective side walls and front wall of the handgun holsters 100 and 200.

Additionally, as shown in FIGS. 11A and 11B, the optional ridge segments 319 extend from the finger button and 355 of the lever 350 to the top of the first side wall 310. A trough 312 is formed between the ridge segments 319, so as to further aid in the proper placement of a user's finger on the finger button portion 351 of the lever 350. It should be should appreciate that the ridge segments 319 may include a textured portion (not shown), such that the ridge segments 319 may be distinguished tactilely from other portions of the holster 300 or the lever 350.

FIGS. 12A-14 show various views of a handgun holster 400 having a retention system that includes a lockout lever 491 and the various components the holster of the present disclosure. As shown in FIGS. 12A-14, the handgun holster 400 includes an open top end 401 and a bottom end 402. The handgun holster 400 further includes a body 403 defining an at least partial cavity 405 (having a trigger guard portion 407 and a frame/slide portion 409) for receiving and holding the handgun.

The body 403 comprises a pair of opposed side walls comprising a first side wall 410, a trough 412, an aperture 416, a recess 417, an optional ridge 418 and/or ridge segments 418 and/or 419, a second side wall 420 (not shown), a front wall 430, and a rear wall 440. The handgun holster 400 further comprises attachment points 470 (not shown), optional slots 484 and 482 (not shown), a passive retention screw 486, optionally the biasing element 490 (not shown), and a retention means comprising a lever 450 having a finger button portion 451 and an engagement portion 455. The lever 450 is pivotally connected, via a pivot pin 460, to the first side wall 410.

It should be understood that each of these elements of the holster 400 shown in FIGS. 12A-14 correspond to and operate similarly to the elements of holsters 100-300, as described above with reference to FIGS. 1-11B. However, as illustrated in FIGS. 12A-14, the first side wall 410, the second side wall 420 (not shown), and the front wall 430 of the handgun holster 400 are slightly different from the respective side walls and front wall of the handgun holsters 100-300.

Figure 12A:
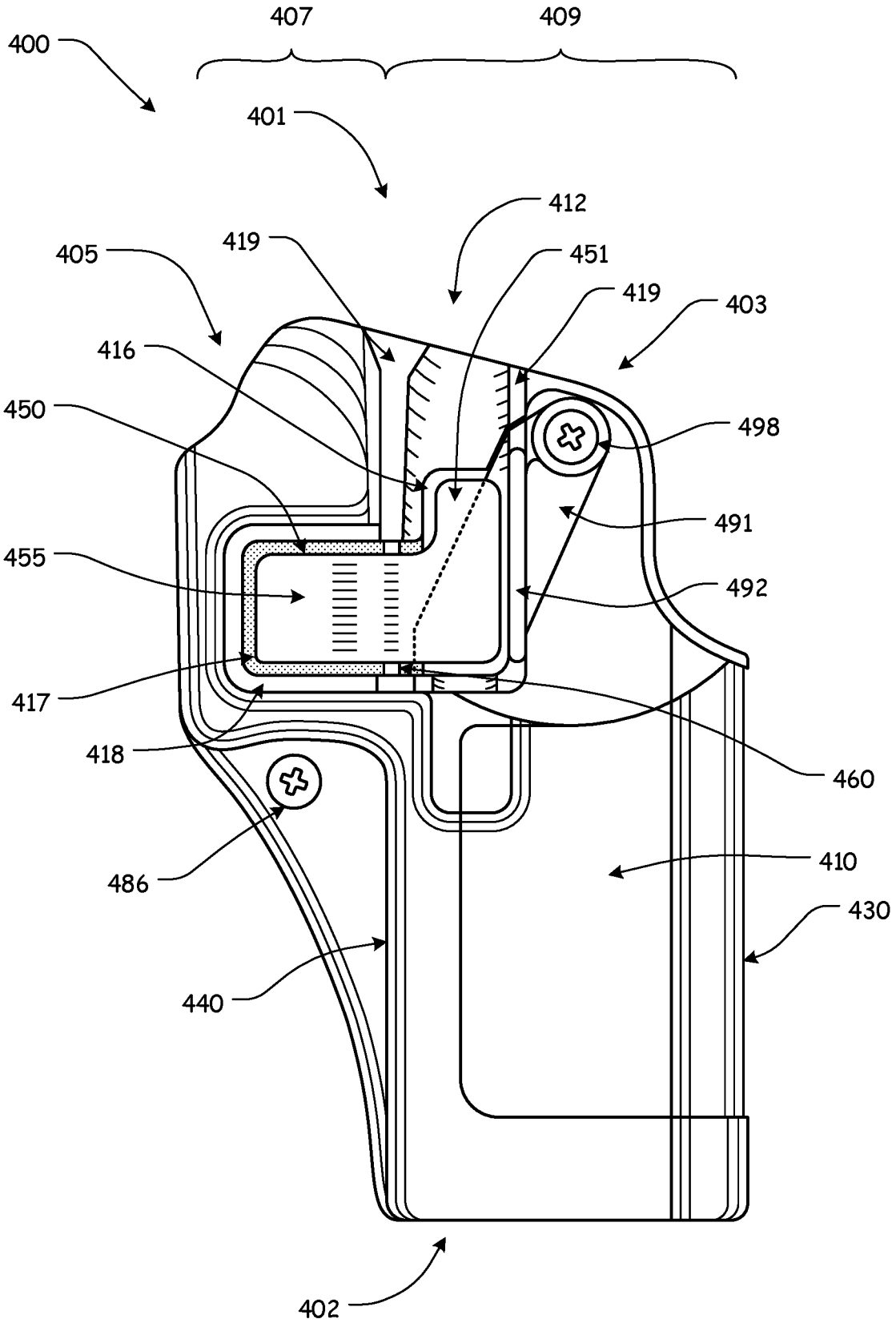
FIG. 12A shows an exemplary embodiment of a handgun holster having a retention system that includes a lockout lever, wherein the lockout lever is in a locked position according to the present disclosure.
Figure 12B:
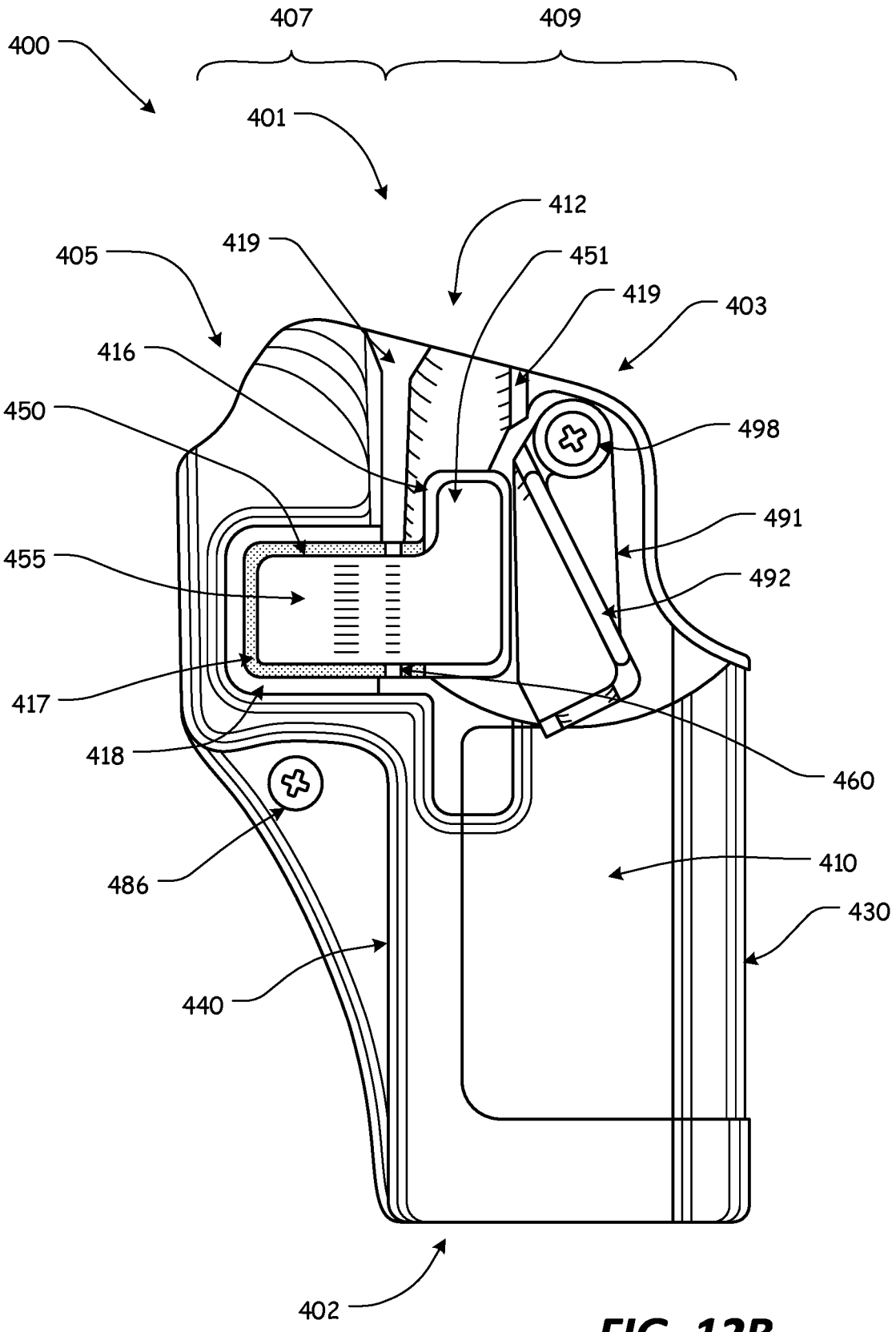
FIG. 12B shows an exemplary embodiment of a handgun holster having a retention system that includes a lockout lever, wherein the lockout lever is in an unlocked position according to the present disclosure.

However, as shown in FIGS. 12A-14, a lockout lever 491 is pivotably attached, via a screw or pivot pin 498, to the first side wall such that the lockout lever 491 is able to be rotated between a locked position (as illustrated in FIG. 12A) and an unlocked position (as illustrated in FIG. 12B).

Figure 13A:
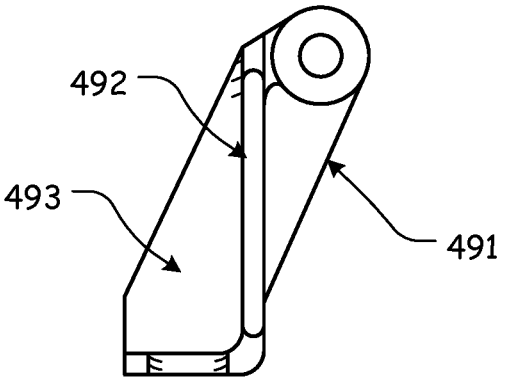
FIG. 13A show more detailed views of the front side of the lockout lever according to the present disclosure.
Figure 13B:
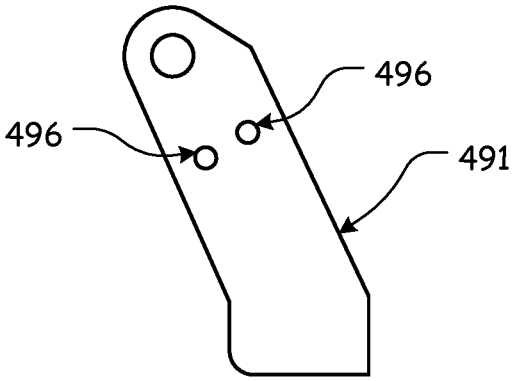
FIG. 13B show more detailed views of the back side of the lockout lever according to the present disclosure.
Figure 14:
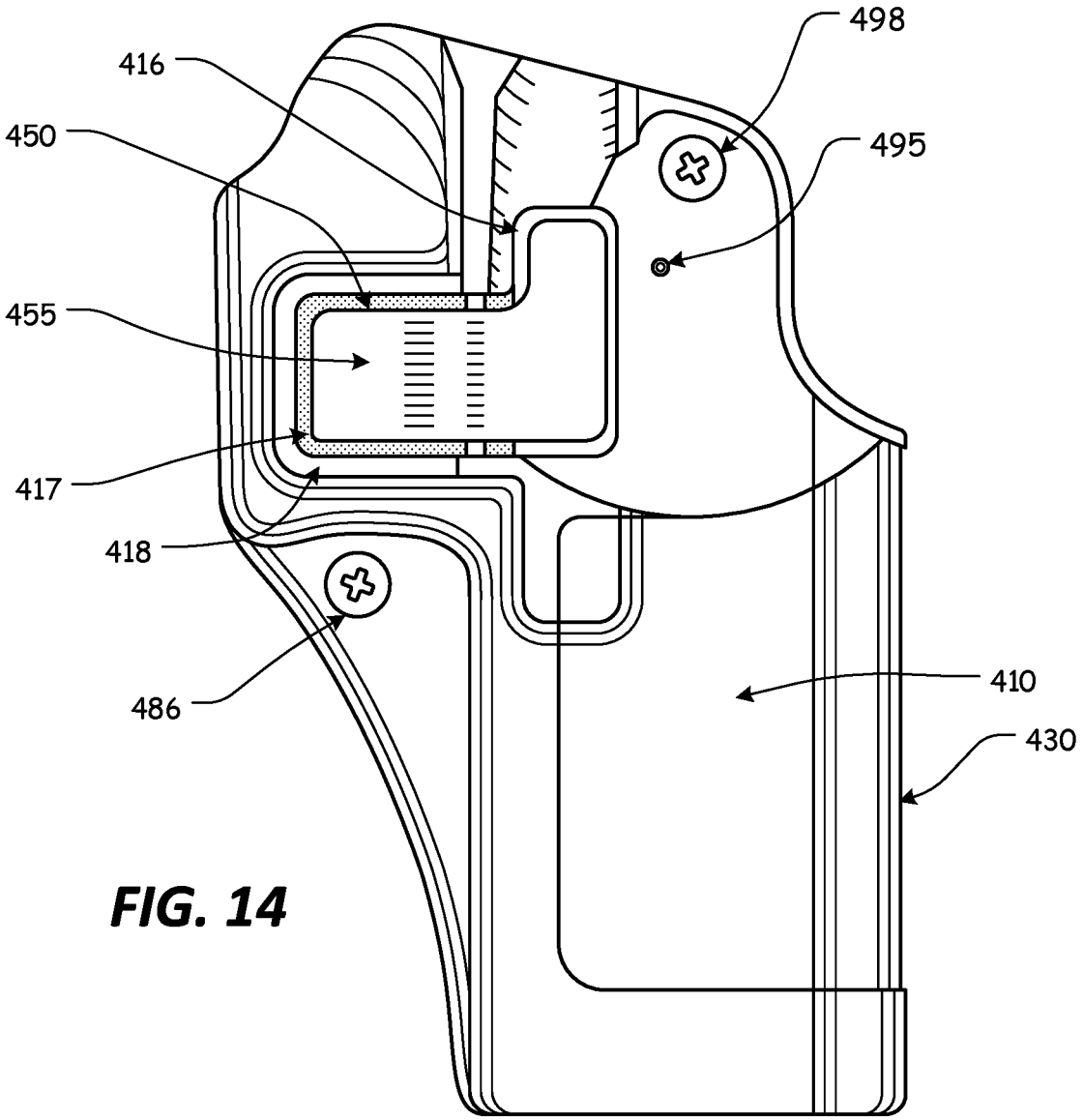
FIG. 14 shows an exemplary embodiment of a handgun holster having a retention system that may be used with a lockout lever, wherein the lockout lever is removed to show an area under the lockout lever.

As illustrated in FIG. 13A, the lockout lever 491 includes a finger engaging portion or ridge 492 that can be engaged or urged by a user's finger to pivot or rotate the lockout lever 491 between the locked and unlocked positions.

The lockout lever 491 includes a locking portion 493 that, when the lockout lever 491 is in the locked position (as illustrated in FIG. 12A), extends below the finger button portion 451 of the release lever 450 to block the finger button portion 451 of the release lever 450 and keep the release lever 450 from being pivoted to the disengaged position, if an attempt is made to pivot the release lever 450 from the engaged to the disengaged position.

When the lockout lever 491 is in the unlocked position (as illustrated in FIG. 12B), the locking portion of the lockout lever 491 is withdrawn from beneath the finger button portion 451 of the release lever 450 so as to allow the finger button portion 451 of the release lever 450 to be pivoted to the disengaged position.

In certain exemplary embodiments, the lockout lever 491 is freely rotatable between the locked position and the unlocked position. Alternatively, the lockout lever 491 may be frictionally maintained, by, for example, frictional engagement between the holster body 403 and the lockout lever 491, in either the locked or the unlocked position unless a force is applied, i.e., by a user's finger, to slide the lockout lever 491 to the locked or unlocked position. In various exemplary embodiments, frictional engagement between the surfaces of the holster body 403 and the lockout lever 491 works to maintain the lockout lever 491 in a desired position.

In other exemplary embodiments, one or more mating protrusions 495 and/or detents 496 (as illustrated most clearly in FIGS. 13B and 14), or other means may be provided to maintain the lockout lever 491 in the locked or unlocked position.

In order for a user to depresses the finger button portion 451 of the release lever 450 a sufficient distance to pivot the release lever 450 to the disengaged position, the lockout lever 491 must be in the unlocked position (as illustrated in FIG. 12B). If the lockout lever 491 is in the locked position (as illustrated in FIG. 12A), the locking portion 493 is positioned so as to contact a bottom surface of the finger button portion 451 and block the finger button portion 451 of the release lever 450 and keep the release lever 450 from being pivoted to the disengaged position.

In various exemplary embodiments, the lockout lever 491 may include one or more lockout apertures (not shown). If included, the lockout apertures allow a lock or other device to be positioned within a portion of the locking portion to maintain the lockout lever 491 in the locked or unlocked position.

Figure 15A:
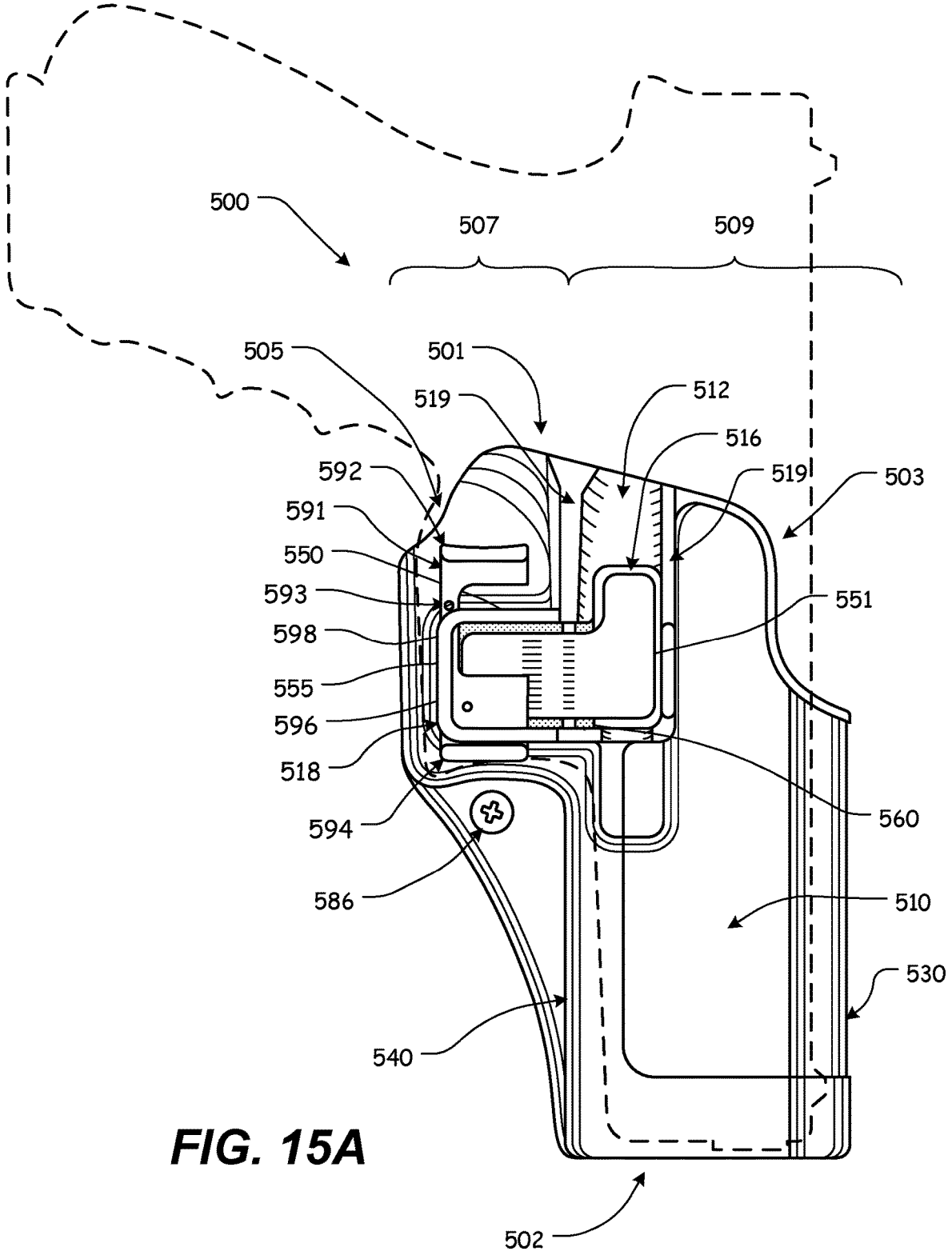
FIG. 15A shows an exemplary embodiment of a handgun holster having a retention system, showing a locking slider in a locked position according to the present disclosure.
Figure 15B:
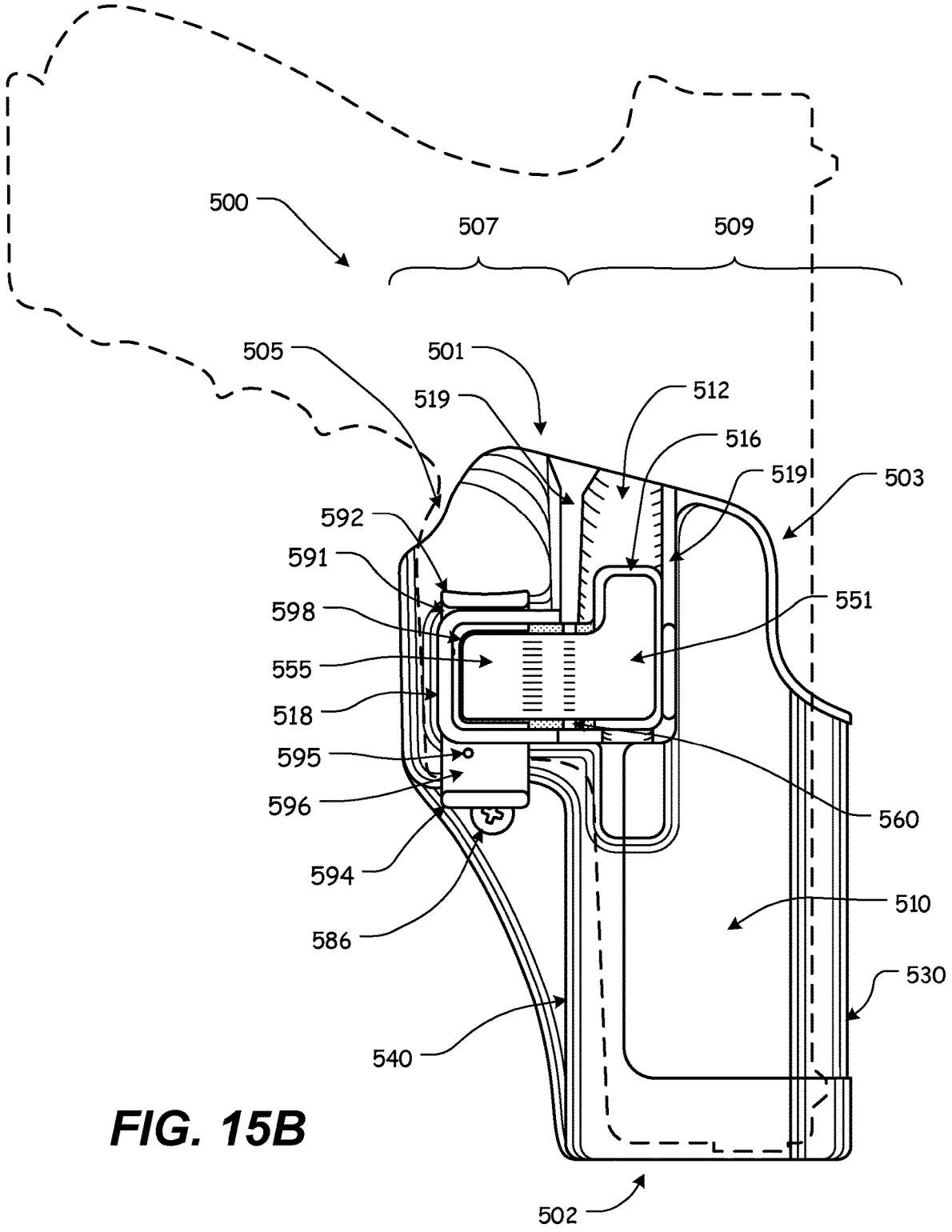
FIG. 15B shows an exemplary embodiment of a handgun holster having a retention system, showing the locking slider in an unlocked position according to the present disclosure.
Figure 16A:
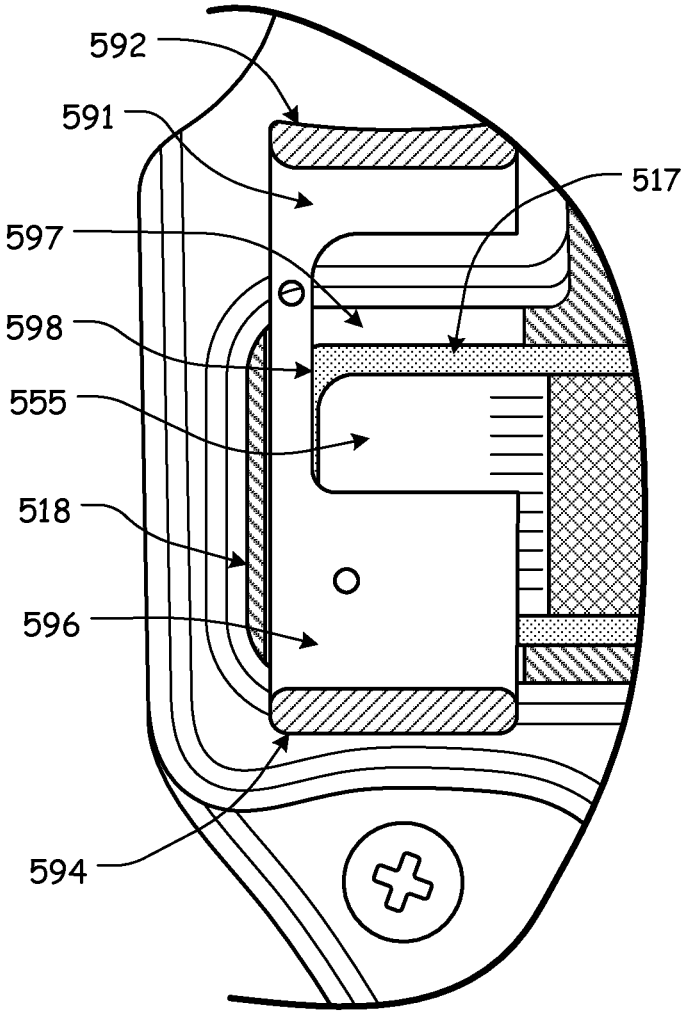
FIG. 16A shows a more detailed, cross-sectional view of the retention system of the exemplary embodiment of a handgun holster having a retention system and a locking slider, showing the locking slider in a locked position according to the present disclosure.
Figure 16B:
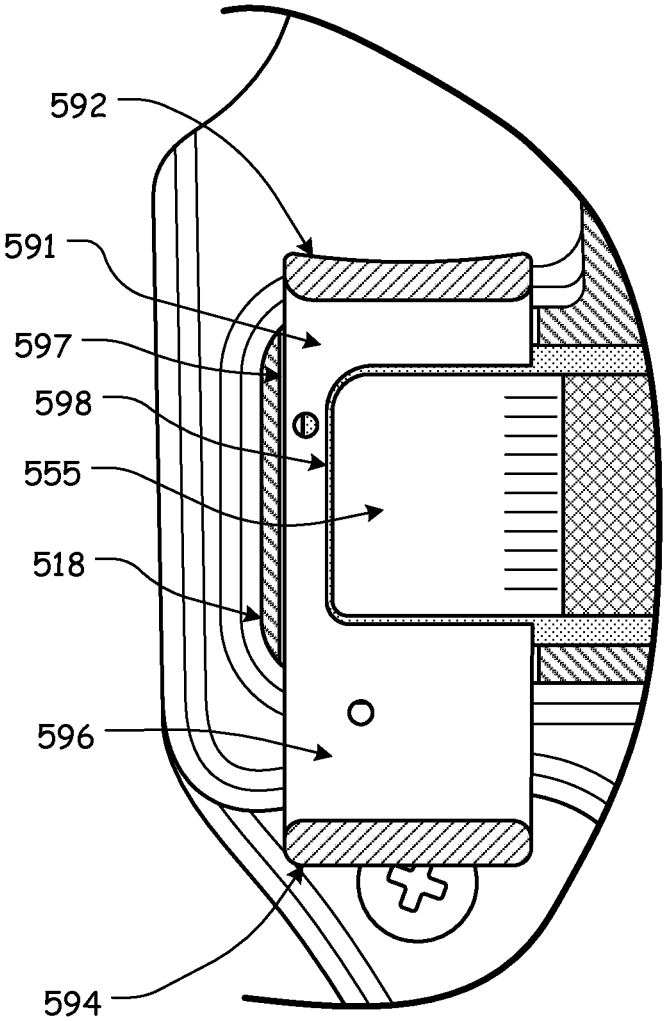
FIG. 16B shows a more detailed, cross-sectional view of the retention system of the exemplary embodiment of a handgun holster having a retention system and a locking slider, showing the locking slider in an unlocked position according to the present disclosure.
Figure 17:
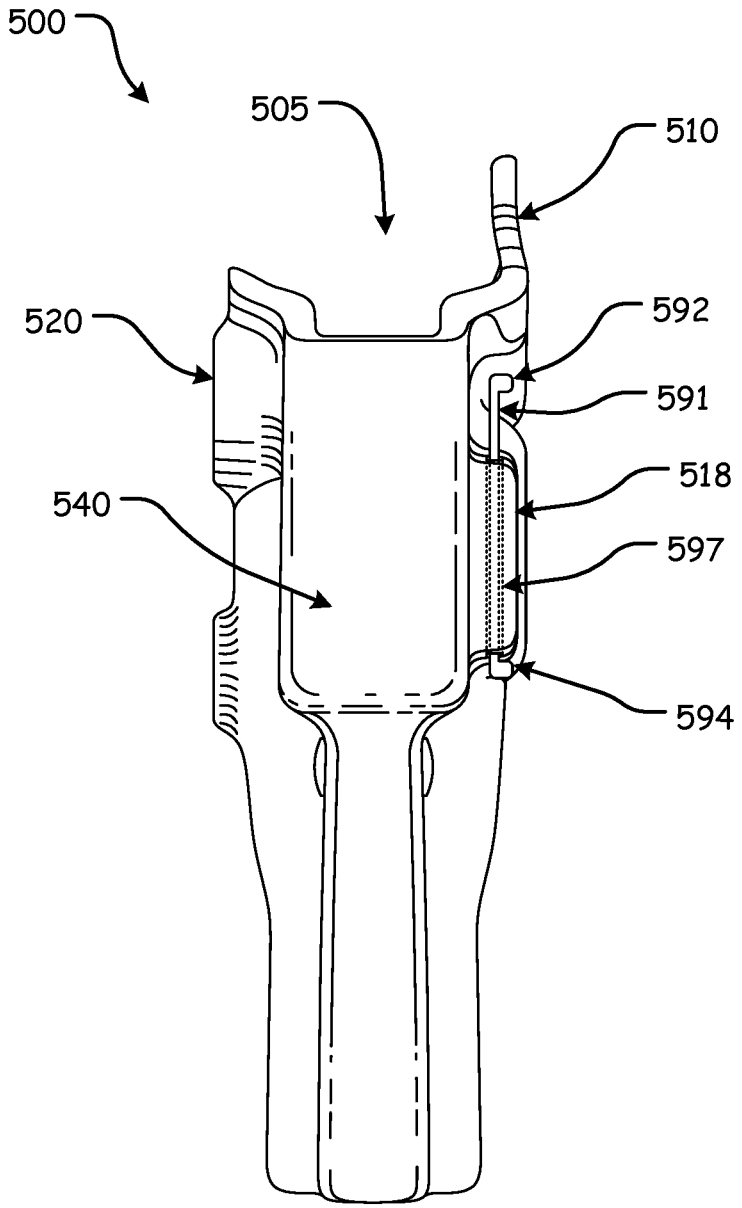
FIG. 17 shows a rear elevation view of an exemplary handgun holster having a retention system and a locking slider, showing a locking slider in a locked position according to the present disclosure.

FIGS. 15A and 15B show a right side view and FIG. 17 shows a rear view of an exemplary embodiment of a handgun holster 500 having a retention system according to the present disclosure. FIG. 16A shows a more detailed, cross-sectional view of the retention system of the retention system of the handgun holster 500, showing the locking slider 591 in a locked position, while FIG. 16B shows a more detailed, cross-sectional view of the retention system of the retention system of the handgun holster 500, showing the locking slider 591 in an unlocked position.

As shown in FIGS. 15A-17, the handgun holster 500 includes an open top end 501 and a bottom end 502. The handgun holster 500 further includes a body 503 defining an at least partial cavity 505 (having a trigger guard portion 507 and a frame/slide portion 509) for receiving and holding the handgun.

The body 503 comprises a pair of opposed side walls comprising a first side wall 510, a trough 512, an aperture 516, a recess 517, an optional ridge 518 and/or ridge segments 518 and/or 519, a second side wall 520 (not shown), a front wall 530, and a rear wall 540. The handgun holster 500 further comprises attachment points 570 (not shown), optional slots 584 and 582 (not shown), a passive retention screw 586, optionally the biasing element 590 (not shown), and a retention means comprising a lever 550 having a finger button portion 551 and an engagement portion 555. The lever 550 is pivotally connected, via a pivot pin 560, to the first side wall 510.

It should be understood that each of these elements of the holster 500 shown in FIGS. 15A-17 correspond to and operate similarly to the elements of holsters 100-400, as described above with reference to FIGS. 1-14.

However, as shown in FIGS. 15A-17, a slot 597 is formed through a portion of the ridge 518 such that a body portion 596 of a locking slider 591 is capable of being slidably maintained within the slot 597.

The body portion 596 of the locking slider 591 extends from a finger engaging portion 592 to a slide stop portion 594 and includes a notch 598 formed in a proportion of the locking slider body portion 596. When slidably positioned within the slot 597, the locking slider 591 is repeatably slidable between a locked position (as illustrated in FIGS. 15A and 16A) and an unlocked position (as illustrated in FIGS. 15B and 16B). The finger engaging portion 592 and the slide stop portion 594 engage portions of the ridge 518 so as to maintain the locking slider 591 within the slot 597.

The notch 598 is shaped so as to allow the engagement portion 555 of the lever 550 to pass therethrough when the locking slider 591 is in the unlocked position and the notch 598 is aligned with the engagement portion 555 (as illustrated in FIGS. 15B and 16B). However, when the locking slider 591 is in the locked position, the body portion 596 is positioned so as to engage the engagement portion 555 of the lever 550 if an attempt is made to pivot the lever 550 from the engaged to the disengaged position and keep the lever 550 from pivoting to the disengaged position (as illustrated in FIGS. 15A and 16A).

In certain exemplary embodiments, the locking slider 591 may freely slide between the locked position and the unlocked position. Alternatively, the locking slider 591 may be naturally maintained either the locked or the unlocked position within the slot 597 unless a force is applied, i.e., by a user's finger, to slide the locking slider 591 to the locked or unlocked position. In various exemplary embodiments, frictional engagement between the surfaces of the slot 597 and the locking slider 591 work to maintain the locking slider and a desired position. In other exemplary embodiments, one or more mating protrusions and/or detents or other means may be provided to maintain the locking slider and the locked or unlocked position.

In order for a user to depresses the finger button portion 551 of the lever 550 of the holster 500 a sufficient distance to pivot the lever 550 to the disengaged position, the locking slider 591 must be in the unlocked position (as illustrated in FIGS. 15A and 16A). If the locking slider 591 is in the locked position (as illustrated in FIGS. 15B and 16B), the body portion 596 is positioned so as to engage the engagement portion 555 of the lever 550 and keep the lever 550 from being pivoted to the disengaged position.

In various exemplary embodiments, the locking slider 591 may include one or more lockout apertures 593 and/or 595. If included, the lockout apertures 593 and/or 595 allow a lock or other device to be positioned within a portion of the body portion 596 to maintain the locking slider 591 in the locked or unlocked position.

FIG. 17 shows handgun holster having a retention system and a locking slider 591, wherein the locking slider 591 is in a locked position according to the present disclosure.

Figure 18A:
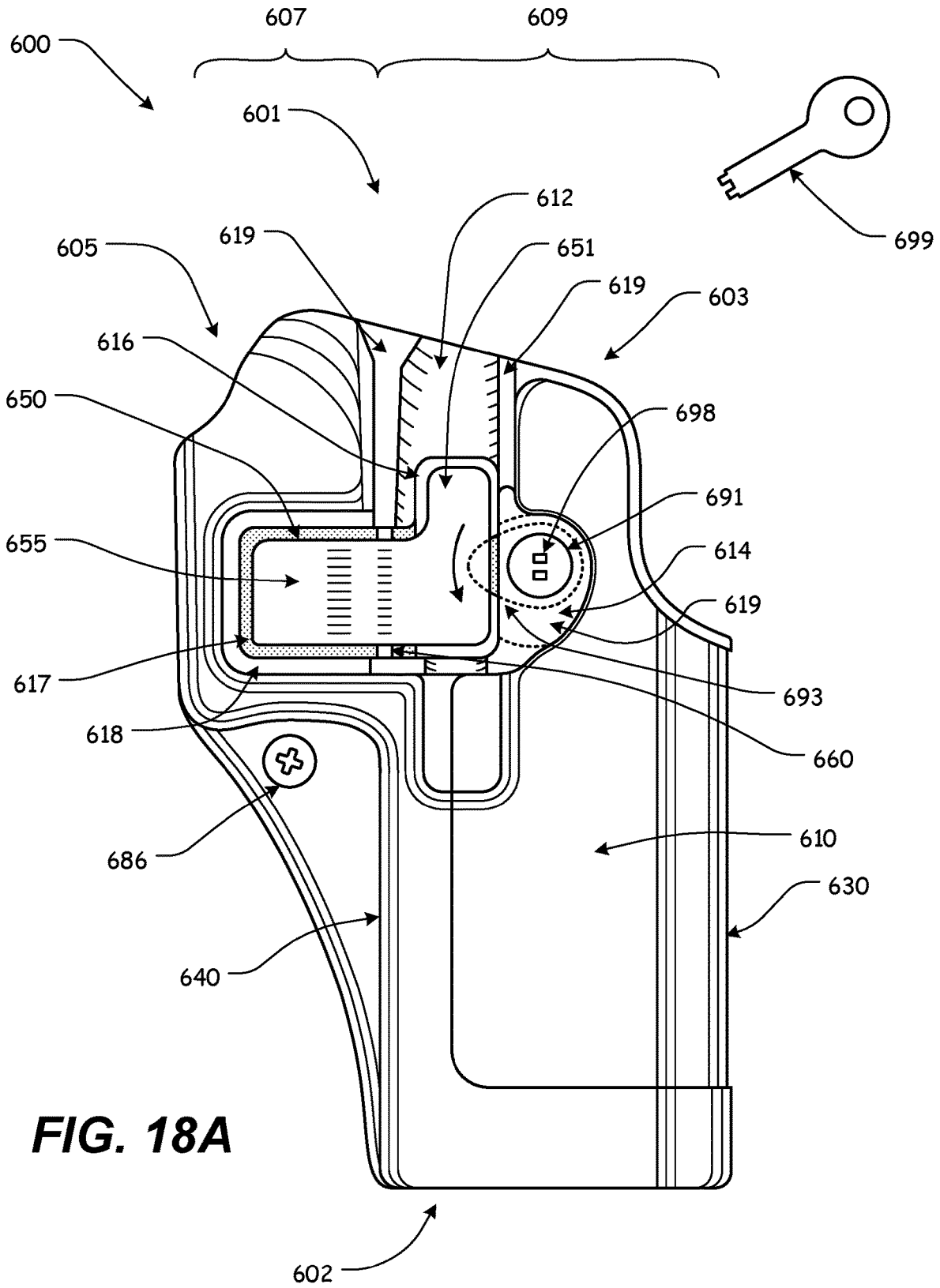
FIG. 18A shows an exemplary embodiment of a handgun holster having a retention system that includes a lockout lever, wherein the lockout lever is in a locked position according to the present disclosure.
Figure 18B:
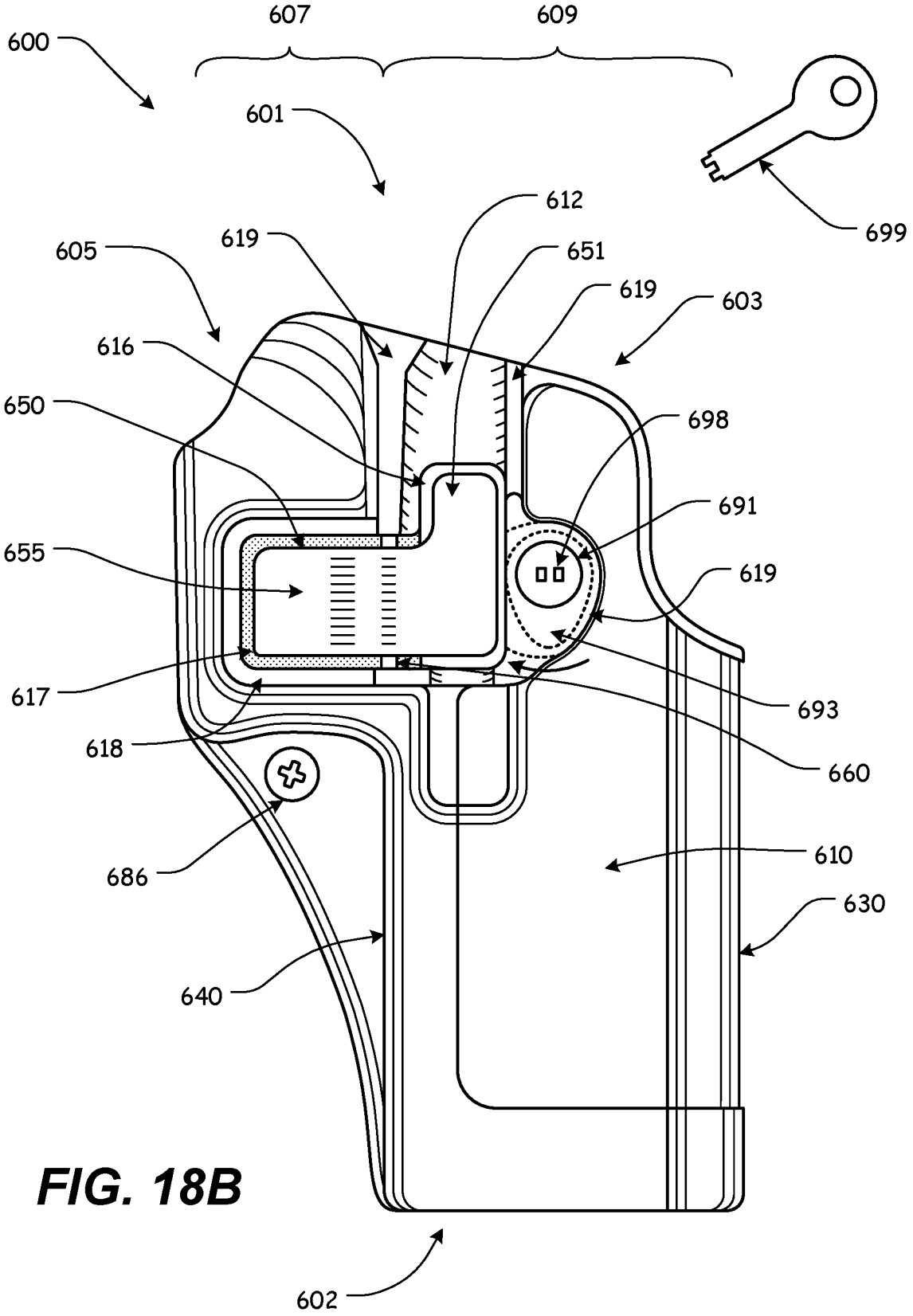
FIG. 18B shows an exemplary embodiment of a handgun holster having a retention system that includes a lockout lever, wherein the lockout lever is in an unlocked position according to the present disclosure.

FIGS. 18A and 18B show an exemplary embodiment of a handgun holster 600 having a retention system according to the present disclosure. FIG. 18A shows the lockout lever 691 in a locked position, while FIG. 18B shows the lockout lever 691 in an unlocked position.

As shown in FIGS. 18A and 18B, the handgun holster 600 includes an open top end 601 and a bottom end 602. The handgun holster 600 further includes a body 603 defining an at least partial cavity 605 (having a trigger guard portion 607 and a frame/slide portion 609) for receiving and holding the handgun.

The body 603 comprises a pair of opposed side walls comprising a first side wall 610, a trough 612, an aperture 616, a recess 617, an optional ridge 618 and/or ridge segments 618 and/or 619, a second side wall 620 (not shown), a front wall 630, and a rear wall 640. The handgun holster 600 further comprises attachment points 670 (not shown), optional slots 684 and 682 (not shown), a passive retention screw 686, optionally the biasing element 690 (not shown), and a retention means comprising a lever 650 having a finger button portion 651 and an engagement portion 655. The lever 650 is pivotally connected, via a pivot pin 660, to the first side wall 610.

It should be understood that each of these elements of the holster 600 shown in FIGS. 18A and 18B correspond to and operate similarly to the elements of holsters 100-300, as described above with reference to FIGS. 1-11B.

However, as shown in FIGS. 18A and 18B, a surface hollow or concavity 614 is formed within a portion of the ridge segment 619 of the side wall 610 such that a lockout lever 691 is rotatably attached within a portion of the hollow 614. The hollow 614 is formed such that a locking portion 693 of a lockout lever 691 is capable of being rotatably maintained within the hollow 614.

In various exemplary embodiments, the lockout lever 691 includes at least one key slot 698 that is capable of interacting with one or more mating portions of a key 699, such that rotation of the lockout lever 691 can be accomplished by interaction of the one or more mating portions of the key 699 and the at least one key slot 698. Thus, through the interaction of a key 699 and key slots 698 of the lockout lever 691, the lockout lever 691 can be rotated between a locked position (as illustrated in FIG. 18A) and an unlocked position (as illustrated in FIG. 18B).

Alternatively, the lockout lever 691 may include certain surface features of preparations that allow the lockout lever 691 to be rotated between the locked position and the unlocked position without use of the key 699.

The lockout lever 691 includes a locking portion 693 that, when the lockout lever 691 is in the locked position (as illustrated in FIG. 18A), extends below the finger button portion 651 of the release lever 650 to block the finger button portion 651 of the release lever 650 and keep the release lever 650 from being pivoted to the disengaged position, if an attempt is made to pivot the release lever 650 from the engaged to the disengaged position.

When the lockout lever 691 is in the unlocked position (as illustrated in FIG. 18B), the locking portion of the lockout lever 691 is withdrawn from beneath the finger button portion 651 of the release lever 650 so as to allow the finger button portion 651 of the release lever 650 to be pivoted to the disengaged position.

In certain exemplary embodiments, the lockout lever 691 is freely rotatable between the locked position and the unlocked position. Alternatively, the lockout lever 691 may be frictionally maintained, by, for example, frictional engagement between the holster body 603 and the lockout lever 691, in either the locked or the unlocked position unless a sufficient force is applied, i.e., by the key 699, to rotate the lockout lever 691 to the locked or unlocked position.

In order for a user to depresses the finger button portion 651 of the release lever 650 a sufficient distance to pivot the release lever 650 to the disengaged position, the lockout lever 691 must be in the unlocked position (as illustrated in FIG. 18B). If the lockout lever 691 is in the locked position (as illustrated in FIG. 18A), the locking portion 693 is positioned so as to contact a bottom surface of the finger button portion 651 and block the finger button portion 651 of the release lever 650 and keep the release lever 650 from being pivoted to the disengaged position.

Figure 19:
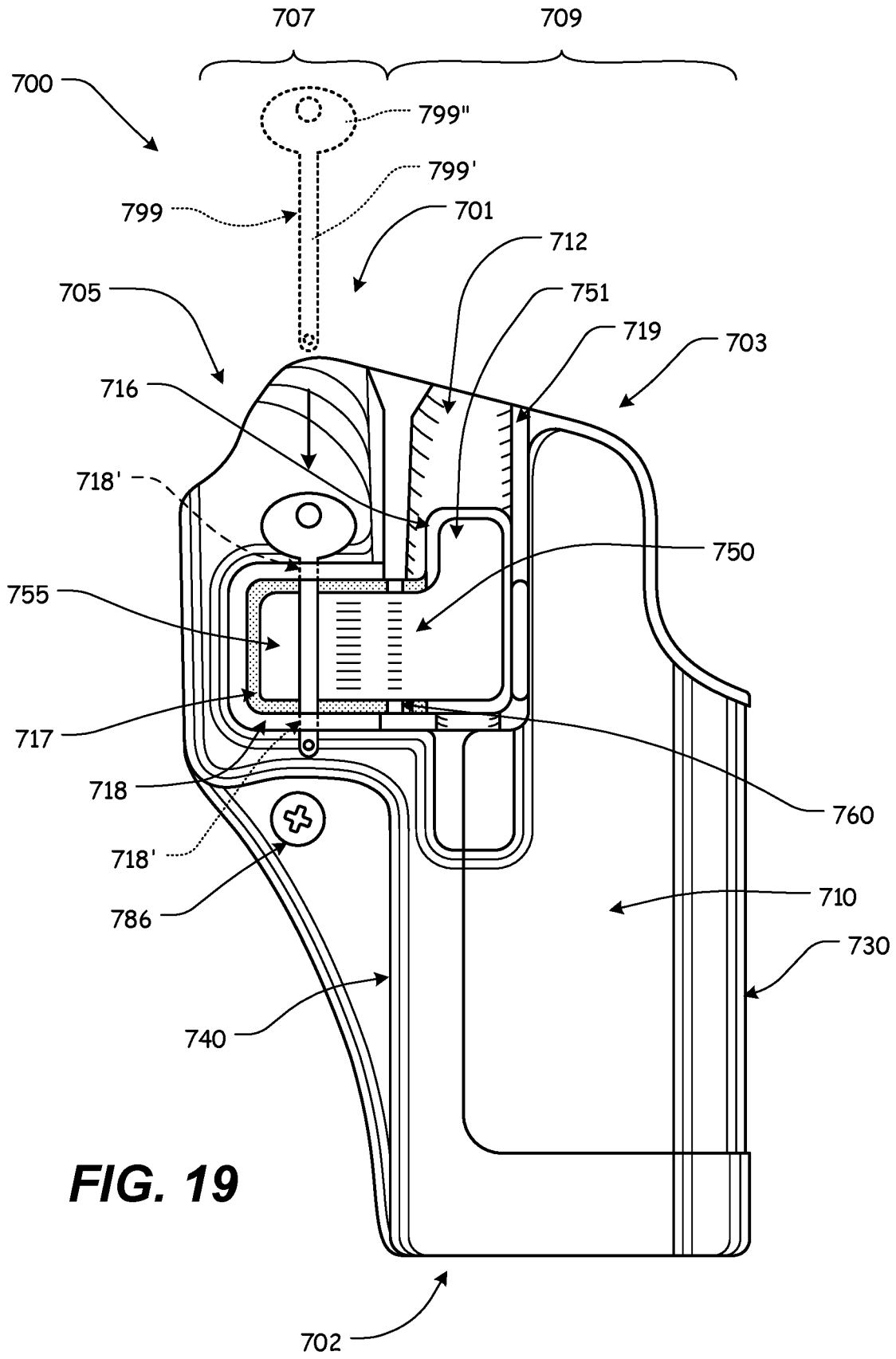
FIG. 19 shows an exemplary embodiment of a handgun holster having a retention system with a lockout element in a retention system lockout position.

FIG. 19 shows an exemplary embodiment of a handgun holster 700 having a retention system with a lockout element 799 in a retention system lockout position. In various exemplary embodiments, the lockout element 799 includes an elongate lockout portion 799' forming a pin, shank, stem, or shaft. In certain exemplary, nonlimiting embodiments, the elongate lockout portion 799' extends from a head or bow 799". As illustrated, the elongate lockout portion 799' has a substantially consistent width or cross-sectional diameter along its entire length. However, the elongate lockout portion 799' may optionally include a shoulder or shoulder portion, which can limit the degree to which the elongate lockout portion can extend into the holster 700. If desired, the lockout element 799 may be formed in the general shape of a key having an optional shoulder and an elongate shaft.

As shown in FIG. 19, the handgun holster 700 includes an open top end 701 and a bottom end 702. The handgun holster 700 further includes a body 703 defining an at least partial cavity 705 (having a trigger guard portion 707 and a frame/slide portion 709) for receiving and holding the handgun.

The body 703 comprises a pair of opposed side walls comprising a first side wall 710, a trough 712, an aperture 716, a recess 717, an optional ridge 718 and/or ridge segments 718 and/or 719, a second side wall 720 (not shown), a front wall 730, and a rear wall 740. The handgun holster 700 further comprises attachment points 770 (not shown), optional slots 784 and 782 (not shown), a passive retention screw 786, optionally the biasing element 790 (not shown), and a retention means comprising a lever 750 having a finger button portion 751 and an engagement portion 755. The lever 750 is pivotally connected, via a pivot pin 760, to the first side wall 710.

It should be understood that each of these elements of the holster 700 shown in FIG. 19 correspond to and operate similarly to the elements of holsters 100-300, as described above with reference to FIGS. 1-11B.

However, as shown in FIG. 19, two aligned lockout element apertures 718' are formed within a portion of the ridge 718 such that a portion of a lockout element 799 may be positioned within the aligned apertures.

When the lockout element 799 is in the retention system lockout position (as illustrated in FIG. 19), a portion of the body of the lockout element 799 extends, between the aligned apertures, above the engagement portion 755 of the release lever 750 to block the engagement portion 755 of the release lever 750 and keep the release lever 750 from being pivoted to the disengaged position, if an attempt is made to pivot the release lever 750 from the engaged to the disengaged position.

Figure 20:
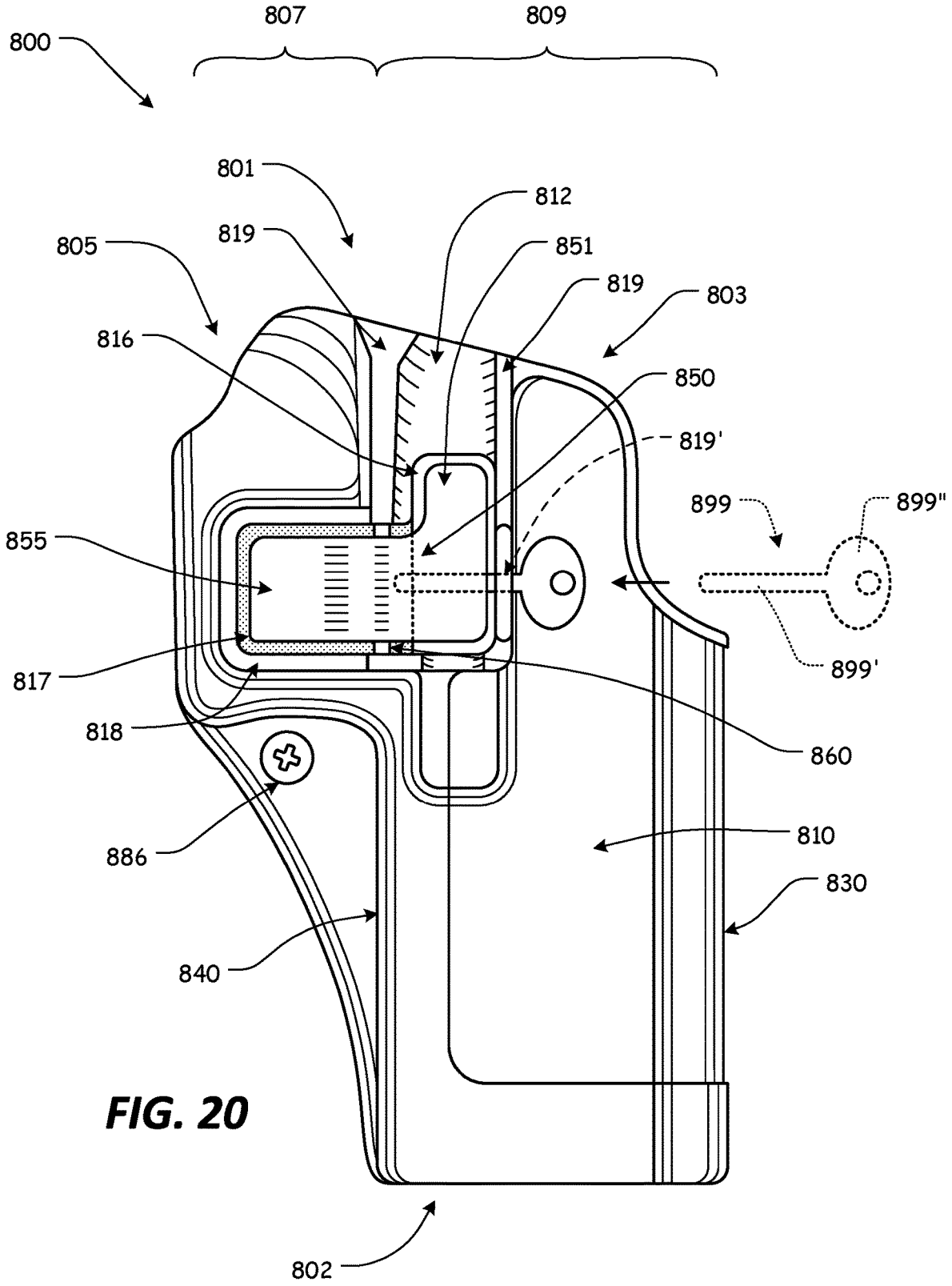
FIG. 20 shows an exemplary embodiment of a handgun holster having a retention system with a lockout element in a retention system lockout position.

FIG. 20 shows an exemplary embodiment of a handgun holster 800 having a retention system with a lockout element 899 in a retention system lockout position. In various exemplary embodiments, the lockout element 899 includes an elongate lockout portion 899' forming a pin, shank, stem, or shaft. In certain exemplary, nonlimiting embodiments, the elongate lockout portion 899' extends from a head or bow 899". As illustrated, the elongate lockout portion 899' has a substantially consistent width or cross-sectional diameter along its entire length. However, the elongate lockout portion 899' may optionally include a shoulder or shoulder portion, which can limit the degree to which the elongate lockout portion can extend into the holster 800. If desired, the lockout element 899 may be formed in the general shape of a key having an optional shoulder and an elongate shaft.

As shown in FIG. 20, the handgun holster 800 includes an open top end 801 and a bottom end 802. The handgun holster 800 further includes a body 803 defining an at least partial cavity 805 (having a trigger guard portion 807 and a frame/slide portion 809) for receiving and holding the handgun.

The body 803 comprises a pair of opposed side walls comprising a first side wall 810, a trough 812, an aperture 816, a recess 817, an optional ridge 818 and/or ridge segments 818 and/or 819, a second side wall 820 (not shown), a front wall 830, and a rear wall 840. The handgun holster 800 further comprises attachment points 870 (not shown), optional slots 884 and 882 (not shown), a passive retention screw 886, optionally the biasing element 890 (not shown), and a retention means comprising a lever 850 having a finger button portion 851 and an engagement portion 855. The lever 850 is pivotally connected, via a pivot pin 860, to the first side wall 810.

It should be understood that each of these elements of the holster 800 shown in FIG. 20 correspond to and operate similarly to the elements of holsters 100-300, as described above with reference to FIGS. 1-11B.

However, as shown in FIG. 20, a lockout element aperture 819' is formed within a portion of the ridge segment 819 such that at least a portion of a lockout element 899 may be positioned within the aperture.

When the lockout element 899 is in the retention system lockout position (as illustrated in FIG. 20), a portion of the body of the lockout element 899 extends, between the aperture and the body 803, below the finger button portion 851 of the release lever 850 to block the finger button portion 851 of the release lever 850 and keep the release lever 850 from being pivoted to the disengaged position, if an attempt is made to pivot the release lever 850 from the engaged to the disengaged position.

Figure 21:
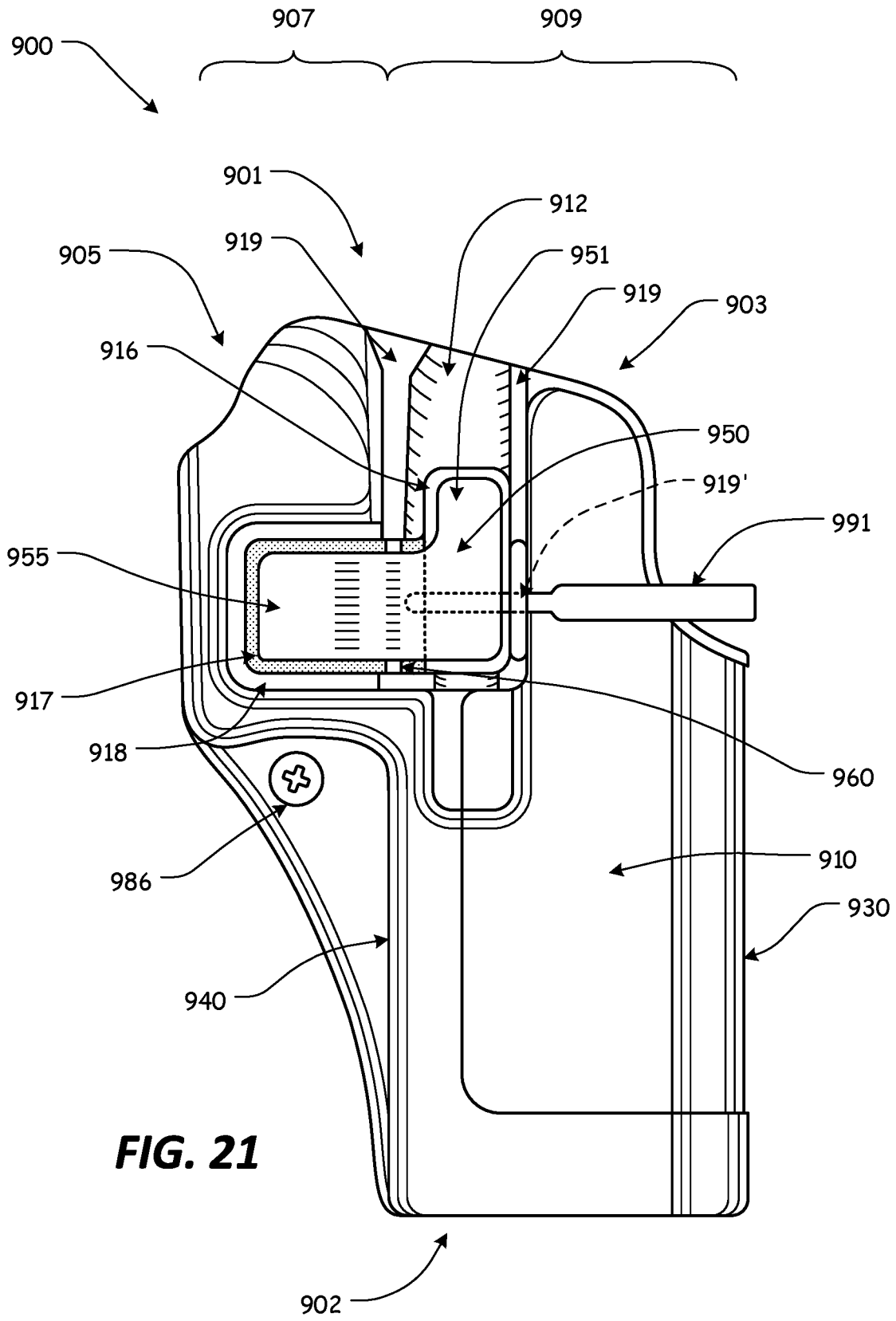
FIG. 21 shows a side view of an exemplary embodiment of a handgun holster having a retention system with a lockout band in a retention system lockout position.
Figure 22:
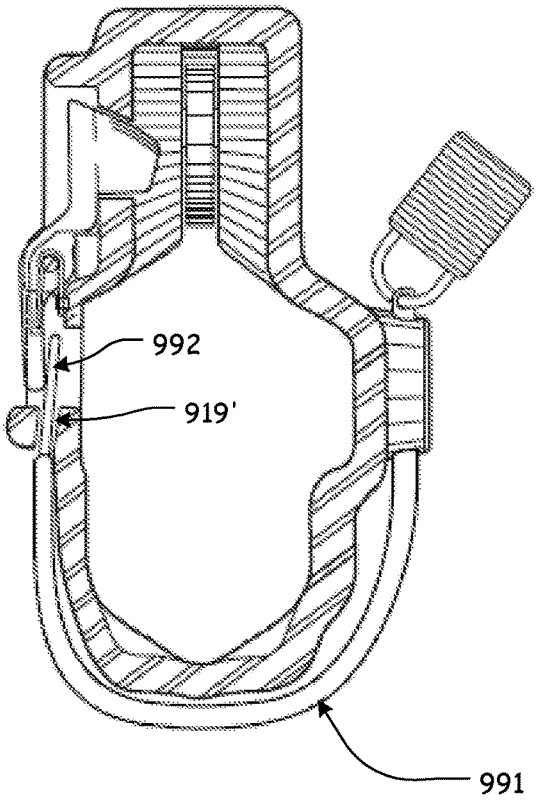
FIG. 22 shows a top, cut-away view of an exemplary embodiment of a handgun holster having a retention system with a lockout band in a retention system lockout position.
Figure 23:
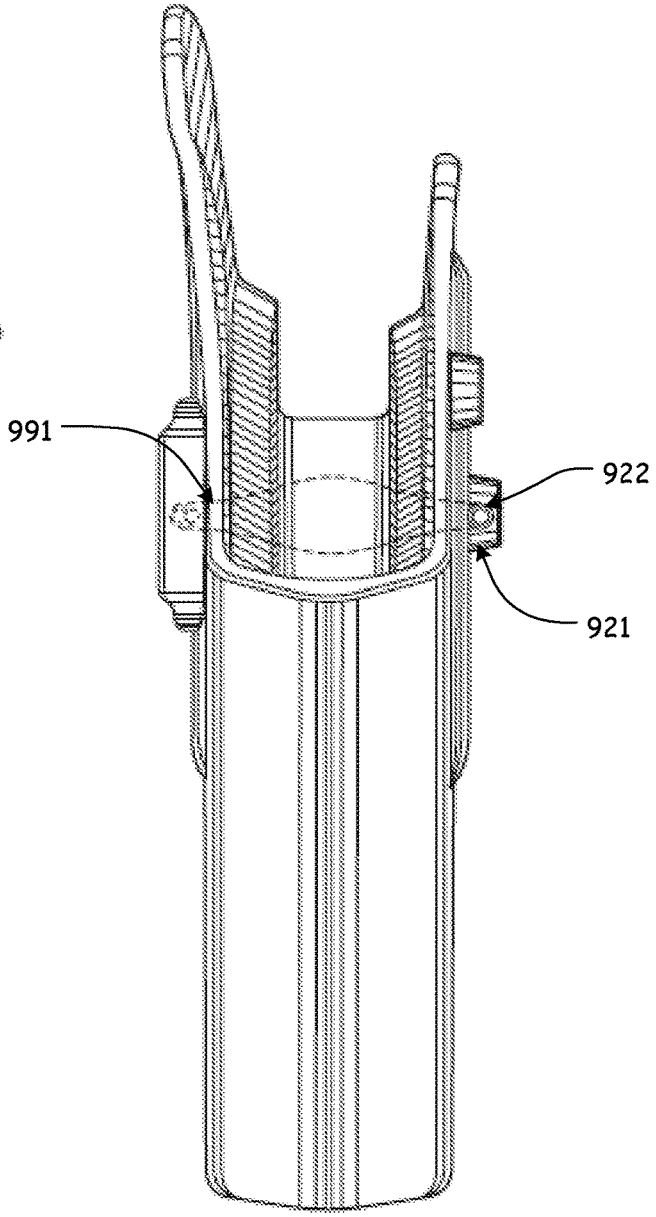
FIG. 23 shows a front view of an exemplary embodiment of a handgun holster having a retention system with a lockout band in a retention system lockout position.

FIGS. 21-23 show an exemplary embodiment of a handgun holster 900 having a retention system with a lockout band 991 in a retention system lockout position.

As shown in FIGS. 21-23, the handgun holster 900 includes an open top end 901 and a bottom end 902. The handgun holster 900 further includes a body 903 defining an at least partial cavity 905 (having a trigger guard portion 907 and a frame/slide portion 909) for receiving and holding the handgun.

The body 903 comprises a pair of opposed side walls comprising a first side wall 910, a trough 912, an aperture 916, a recess 917, an optional ridge 918 and/or ridge segments 918 and/or 919, a second side wall 920 (not shown), a front wall 930, and a rear wall 940. The handgun holster 900 further comprises attachment points 970 (not shown), optional slots 984 and 982 (not shown), a passive retention screw 986, optionally the biasing element 990 (not shown), and a retention means comprising a lever 950 having a finger button portion 951 and an engagement portion 955. The lever 950 is pivotally connected, via a pivot pin 960, to the first side wall 910.

It should be understood that each of these elements of the holster 900 shown in FIGS. 21-23 correspond to and operate similarly to the elements of holsters 100-300, as described above with reference to FIGS. 1-11B.

However, as shown in FIGS. 21-23, lockout element aperture 919' is formed within a portion of the ridge segment 919 such that at least a lockout element portion 992 of a lockout band 991 may be positioned within the aperture. A lockout band aperture 922 is formed within the portion of a ridge segment 921 such that a portion of the lockout band 991 may be positioned within the lockout band aperture 922. When portions of the lockout band 991 are positioned within the lockout element aperture 919' and the lockout band aperture 922, the lockout band 991 is in the retention system lockout position.

When the lockout band 991 is in the retention system lockout position (as illustrated in FIGS. 21-23), a portion of the body of the lockout band 991 extends, between the aperture and the body 903, below the finger button portion 951 of the release lever 950 to block the finger button portion 951 of the release lever 950 and keep the release lever 950 from being pivoted to the disengaged position, if an attempt is made to pivot the release lever 950 from the engaged to the disengaged position.

Figure 24A:
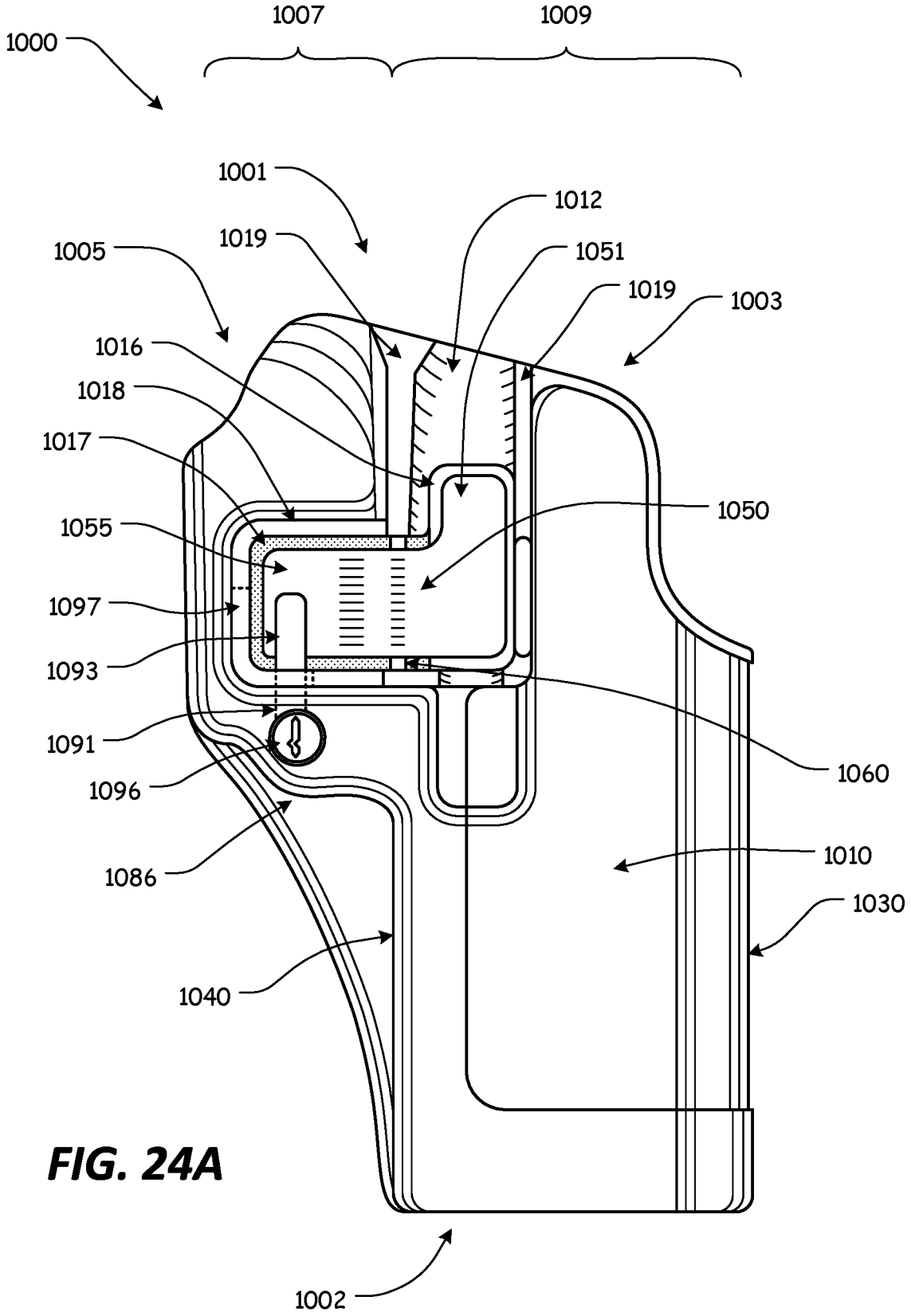
FIG. 24A shows an exemplary embodiment of a handgun holster having a retention system that includes a keyed lockout lever, wherein the keyed lockout lever is in a locked position according to the present disclosure.
Figure 24B:
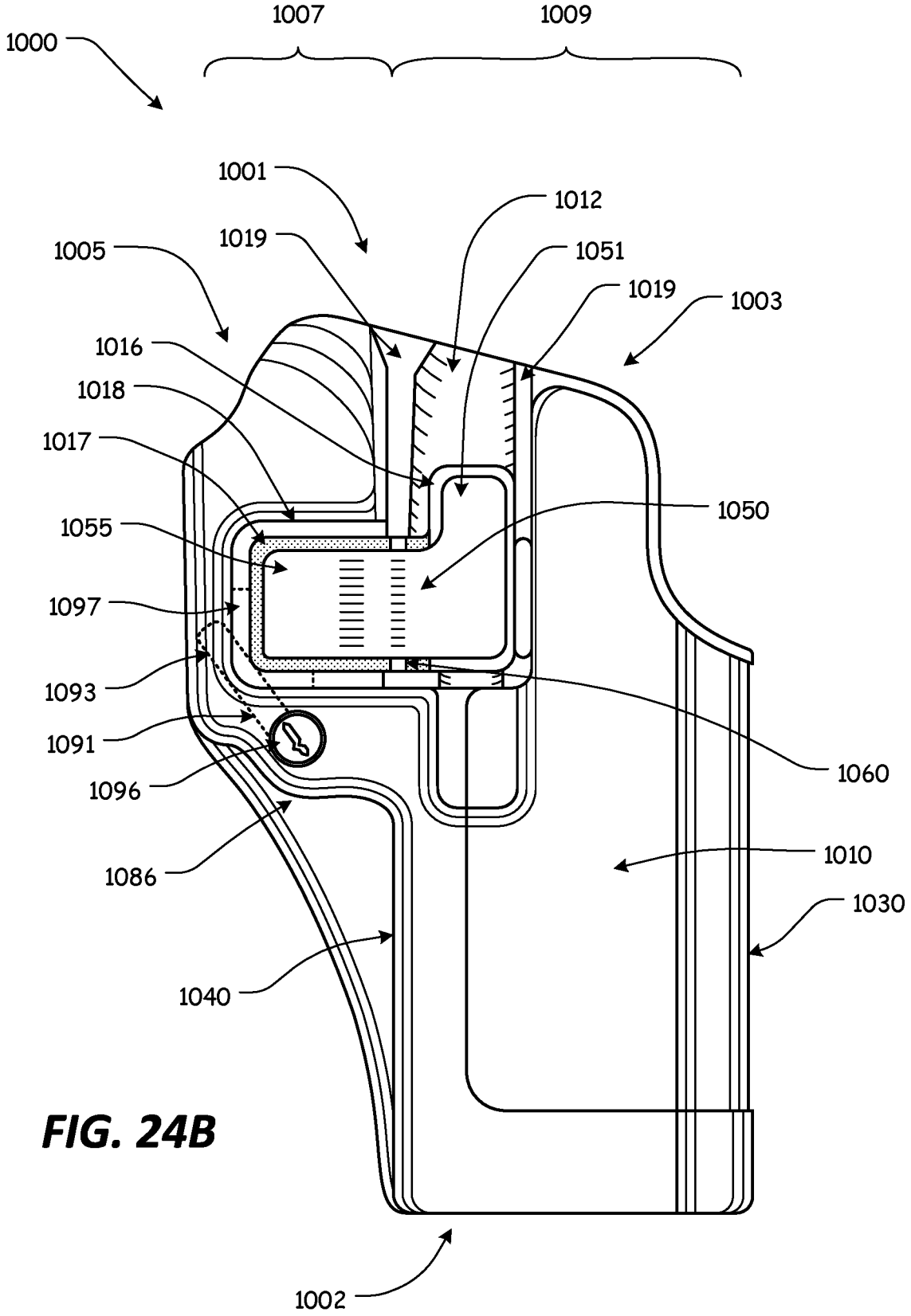
FIG. 24B shows an exemplary embodiment of a handgun holster having a retention system that includes a keyed lockout lever, wherein the keyed lockout lever is in an unlocked position according to the present disclosure.

FIGS. 24A and 24B show an exemplary embodiment of a handgun holster 1000 having a retention system according to the present disclosure. FIG. 24A shows a keyed lockout lever 1091 in a locked position, while FIG. 24B shows the keyed lockout lever 1091 in an unlocked position.

As shown in FIGS. 24A and 24B, the handgun holster 1000 includes an open top end 1001 and a bottom end 1002. The handgun holster 1000 further includes a body 1003 defining an at least partial cavity 1005 (having a trigger guard portion 1007 and a frame/slide portion 1009) for receiving and holding the handgun.

The body 1003 comprises a pair of opposed side walls comprising a first side wall 1010, a trough 1012, an aperture 1016, a recess 1017, an optional ridge 1018 and/or ridge segments 1018 and/or 1019, a second side wall 1020 (not shown), a front wall 1030, and a rear wall 1040. The handgun holster 1000 further comprises attachment points 1070 (not shown), optional slots 1084 and 1082 (not shown), a passive retention screw 1086, optionally the biasing element 1090 (not shown), and a retention means comprising a lever 1050 having a finger button portion 1051 and an engagement portion 1055. The lever 1050 is pivotally connected, via a pivot pin 1060, to the first side wall 1010.

It should be understood that each of these elements of the holster 1000 shown in FIGS. 24A and 24B correspond to and operate similarly to the elements of holsters 100-300, as described above with reference to FIGS. 1-11B.

However, as shown in FIGS. 24A and 24B, an at least partial cavity is formed within a portion of the ridge 1018 such that a keyed lockout lever 1091 is pivotably attached within a portion of the side wall 1010. The at least partial cavity is formed such that a locking portion 1093 of a keyed lockout lever 1091 is capable of being maintained within the at least partial cavity.

A slot 1097 is formed through a portion of the ridge 1018 such that a body portion 1096 of the keyed lockout lever 1091 is capable of being slidably maintained within the slot 1097. Through the interaction of a key and the body portion 1096 of the keyed lockout lever 1091, the keyed lockout lever 1091 is able to be rotated between a locked position (as illustrated in FIG. 24A) and an unlocked position (as illustrated in FIG. 24B).

The keyed lockout lever 1091 includes a locking portion 1093 that, when the keyed lockout lever 1091 is in the locked position (as illustrated in FIG. 24A), extends above the engagement portion 1055 of the release lever 1050 to block the engagement portion 1055 of the release lever 1050 and keep the release lever 1050 from being pivoted to the disengaged position, if an attempt is made to pivot the release lever 1050 from the engaged to the disengaged position.

When the keyed lockout lever 1091 is in the unlocked position (as illustrated in FIG. 24B), the locking portion 1093 of the keyed lockout lever 1091 is withdrawn from above the engagement portion 1055 of the release lever 1050 so as to allow the engagement portion 1055 of the release lever 1050 to be pivoted to the disengaged position.

In order for a user to depresses the finger button portion 1051 of the release lever 1050 a sufficient distance to pivot the release lever 1050 to the disengaged position, the keyed lockout lever 1091 must be in the unlocked position (as illustrated in FIG. 24B). If the keyed lockout lever 1091 is in the locked position (as illustrated in FIG. 24A), the locking portion 1093 is positioned so as to contact a top surface of the engagement portion 1055 and block the engagement portion 1055 of the release lever 1050 and keep the release lever 1050 from being pivoted to the disengaged position.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A holster for a handgun, comprising:

a holster body having opposing sidewalls, a front wall, and a rear wall, the holster body defining an at least partial cavity, a bottom end and an open top end leading to the at least partial cavity, the at least partial cavity having a frame/slide receiving portion and a trigger guard receiving portion, wherein the rear wall extends to the bottom end, wherein the holster body has an axis defined along the rear wall, wherein the axis separates the frame/slide receiving portion and the trigger guard receiving portion;

a lever having a thumb button portion and a handgun engagement portion, wherein said lever includes a locking projection extending from at least a portion of said handgun engagement portion, wherein said lever is pivotally attached or coupled to at least a portion of said holster, approximately between said thumb button portion and said engagement portion, and wherein said lever is pivotable between an engaged position and a disengaged position by depressing the thumb button; and a biasing element comprising an arcuate spring mechanism secured to the holster body by a retention screw, the retention screw extending between the opposite sidewalls of the holster body and positioned below the trigger guard portion of the cavity, the arcuate spring mechanism extending toward the front wall into the frame/slide receiving portion of the cavity.

2. The holster of claim 1, wherein said lever is biased to said engaged position.

3. The holster of claim 1, further comprising a lockout element rotatably attached or coupled to at least a portion of said holster body, wherein if said lockout element is in said locked position, at least a portion of said locking portion of said lockout element extends beneath said thumb button portion of said release lever to keep said release lever from pivoting to said disengaged position, and wherein if said lockout element is in said unlocked position, said locking portion of said lockout element is withdrawn from beneath said thumb button portion of said release lever so as to allow said release lever to be pivoted to said disengaged position.

4. The holster of claim 1, further comprising a lockout element rotatably attached or coupled to at least a portion of said holster body, and further comprising a key, and wherein said lockout element is rotatable between a locked position and an unlocked position by the key.

5. The holster of claim 1, wherein the locking projection extends into the handgun trigger guard receiving portion and the lever is pivotable between a trigger guard engaged position and a trigger guard disengaged position.

6. The holster of claim 1, further comprising a lockout element rotatably attached or coupled to at least a portion of said holster body, wherein a portion of the locking portion of said lockout element is positioned beneath at least a portion of said thumb button portion of said lever when said lockout element is in said locked position.

7. A holster for a handgun, the holster comprising:

a holster body with a top end, a bottom end, a front wall, a rear wall, and a pair of opposing sidewalls defining an at least partial cavity, the at least partial cavity including a handgun slide receiving portion at the front wall and a handgun trigger guard receiving portion at the rear wall, the opposing sidewalls comprising a first side wall that is oriented to be worn adjacent the user's body and a second side wall oriented to be worn away from the user's body, wherein the rear wall extends to the bottom end, wherein the holster body has an axis defined along the rear wall, wherein the axis separates the slide receiving portion and the trigger guard receiving portion;

a lever having a thumb button portion and an engagement portion, wherein said lever includes a handgun locking projection extending from at least a portion of said engagement portion the engages and blocks the removal of the handgun when holstered, wherein said lever is pivotally attached or coupled to the first side wall and is biased to a handgun engaging and blocking position, and a biasing element comprising an arcuate spring mechanism secured to the holster body by a retention screw, the retention screw extending between the opposite sidewalls of the holster body and positioned below the trigger guard portion of the cavity, the arcuate spring mechanism extending toward the front wall into the slide receiving portion of the cavity.

8. The holster of claim 7, wherein the holster body has a lockout aperture or slot proximate the lever and extending in a direction with the first sidewall; and the holster further comprising a lockout element having a portion slidably movable in the lockout aperture or slot and into a blocking position with the lever thereby blocking the lever from pivoting from the handgun engaging and blocking position to a disengaged position, the lockout element movable from the blocking position with the lever to a non-blocking position; and wherein the lockout element is a rotatable element that is rotatably attached to the first side wall.

9. The holster of claim 8, wherein the rotatable element has a slot, and the holster further comprises a key sided to be received by the slot, the rotatable element rotatable from the blocking position to the non-blocking position by way of the key.

10. The holster of claim 7, wherein the locking projection extends into the handgun trigger guard receiving portion and the lever is pivotable between a trigger guard engaged position and a trigger guard disengaged position.

11. The holster of claim 9, wherein the locking projection extends into the handgun trigger guard receiving portion and the lever is pivotable between a trigger guard engaged position and a trigger guard disengaged position.

12. The holster of claim 7, further comprising a lockout element rotatably attached or coupled to at least a portion of said holster body, wherein the body has the lockout aperture and the lockout element is received in the lockout aperture and is slidingly separable from the holster body.

13. The holster of claim 12, wherein the lockout element has a straight portion and is separable from the holster body by slidingly moving the straight portion out of the lockout aperture in the direction with the one of the pair of sidewalls whereby the lever may then be pivoted to the trigger guard disengaged position.

14. The holster of claim 12, wherein said lockout element is key shaped with a slender straight portion and an enlarged and flat head portion connected thereto.

15. The holster of claim 12, wherein said lockout element is configured as a band.

16. The holster of claim 12, wherein the holster has the slot proximate the lever and wherein said lockout element is a locking slider captured within the slot.

17. The holster of claim 16, wherein the locking slider has a thumb engaging portion outside of the slot and projecting only to the left of the body portion.

18. The holster of claim 16, wherein said locking slider is frictionally maintained in said locked or said unlocked position unless a sufficient force is applied to slide said locking slider by a user.

19. A holster for a handgun, comprising:

a holster body having opposing sidewalls, a front wall, and a rear wall, the holster body defining an at least partial cavity, a bottom end and an open top end leading to the at least partial cavity, the at least partial cavity having a frame/slide receiving portion and a trigger guard portion, wherein the rear wall extends to the bottom end, wherein the holster body has an axis defined along the rear wall, wherein the axis separates the frame/slide receiving portion and the trigger guard receiving portion;

a retention system comprising a lever having a thumb button portion, wherein said lever is pivotally attached or coupled to at least a portion of said holster, and wherein said lever is pivotable between an engaged position and a disengaged position by depressing the thumb button; and a biasing element comprising an arcuate spring mechanism secured to the holster body by a retention screw, the retention screw extending between the opposite sidewalls of the holster body and positioned below the trigger guard portion of the cavity, the arcuate spring mechanism extending toward the front wall into the frame/slide receiving portion of the cavity.

20. The holster of claim 19, wherein said lever is biased to said engaged position.

* * * * *